US012324965B2

(12) United States Patent
McDermott et al.

(10) Patent No.: US 12,324,965 B2
(45) Date of Patent: Jun. 10, 2025

(54) HIGH HARDNESS GRADIENT GOLF BALL CORES AND METHODS OF MAKING SAME

(71) Applicant: Acushnet Company, Fairhaven, MA (US)

(72) Inventors: Erin McDermott, Providence, RI (US); Manjari Kuntimaddi, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/070,970

(22) Filed: Nov. 29, 2022

(65) Prior Publication Data

US 2024/0173595 A1 May 30, 2024

(51) Int. Cl.
*A63B 37/06* (2006.01)
*A63B 37/00* (2006.01)

(52) U.S. Cl.
CPC ..... *A63B 37/0063* (2013.01); *A63B 37/0058* (2013.01); *A63B 37/0072* (2013.01)

(58) Field of Classification Search
CPC ..... A63B 37/0062; A63B 37/0063; A63B 37/005
See application file for complete search history.

(56) References Cited

U.S. PATENT DOCUMENTS 4,650,193 A * 3/1987 Molitor ..... A63B 37/0031 473/373
6,677,401 B2 1/2004 Boehm et al.
6,756,436 B2 6/2004 Rajagopalan et al.
6,774,187 B2 8/2004 Voorheis et al.
6,982,301 B1 1/2006 Voorheis et al.
6,992,135 B2 1/2006 Boehm et al.
7,670,542 B2 3/2010 Hogge et al.
2003/0209840 A1* 11/2003 Hogge ..... B29C 35/0805 264/492
2008/0268982 A1* 10/2008 Comeau ..... A63B 37/0074 473/371
2020/0001142 A1* 1/2020 Yamanaka ..... A63B 37/00776

OTHER PUBLICATIONS

Dalton, J., Science and Golf IV, Proceedings of the World Scientific Congress of Golf, "Compression by Any Other Name", (Eric Thain ed., Routledge, 2002), pp. 319-327.

* cited by examiner

*Primary Examiner* — Raeann Gorden
(74) *Attorney, Agent, or Firm* — Bradley Arant Boult Cummings LLP

(57) ABSTRACT

Compositions including a water releasing agent and golf ball cores made from such compositions having a high hardness gradient are disclosed. The type and concentration of the components in the composition, including the water releasing agent, affect the hardness and hardness gradient of cores made from the composition and, thus, can be used to produce a golf ball having desirable performance characteristics. Cores made from the composition may be cured using infrared radiation to further increase the hardness and hardness gradient of such cores. Cores cured using infrared radiation may have a center and a skin with hardness greater than the hardness of the center to produce a high hardness gradient.

19 Claims, 4 Drawing Sheets

HIGH HARDNESS GRADIENT GOLF BALL CORES AND METHODS OF MAKING SAME

FIELD OF THE INVENTION

The present disclosure relates generally to golf ball cores having a center and a skin with a hardness greater than the hardness of the center to produce a high hardness gradient across the core. More particularly, the present disclosure provides compositions and golf ball cores made from such compositions that have a high hardness gradient. The present disclosure also provides methods of making cores having a center and a skin with a hardness greater than the hardness of the center to produce a high hardness gradient. In some respects, the present disclosure relates to high gradient golf ball cores that, when used in golf balls, provide the ability to achieve one or more desired performance characteristics including, for example, reduced spin on driver shots.

BACKGROUND OF THE INVENTION

Solid golf balls are typically made with a solid core encased by a cover, both of which can have multiple layers, such as a dual core having a solid center (or inner core) and an outer core layer, or a multi-layer cover having inner and outer cover layers. Generally, golf ball cores and/or centers are constructed with a thermoset rubber, such as a polybutadiene-based composition.

Thermoset rubbers are heated and crosslinked in a variety of processing steps to create a golf ball core having certain desirable characteristics, such as higher or lower compression or hardness, that can impact the spin rate of the ball and/or provide better "feel." These and other characteristics can be tailored to the needs of golfers of different abilities. For example, professional and highly skilled amateur golfers can place a back spin more easily on balls having a relatively high spin rate, which helps better control the ball and improves shot accuracy and placement. On the other hand, recreational players who cannot intentionally control the spin of the ball when hitting it with a club are less likely to use high spin balls. Due to the nature of thermoset materials and the heating/curing cycles used to form the materials into cores, manufacturers can achieve varying properties across the core (i.e., from the core surface to the center of the core).

In a conventional, polybutadiene-based core, the physical properties of the molded core are highly dependent on the curing cycle (i.e., the time and temperature that the core is subjected to during molding). This time and temperature history, in turn, is inherently variable throughout the core, with the center of the core being exposed to a different time/temperature (i.e., shorter time at a different temperature) than the surface (because of the time it takes for heat to transfer to the center of the core) allowing a property gradient to exist at points between the center and core surface. This physical property gradient is readily measured as a hardness gradient.

The prior art contains a number of references that discuss "hard-to-soft" hardness gradients across a thermoset golf ball core. The "hard-to-soft" hardness gradients are typically in the range of 5 to 30 Shore C. While these hardness gradients can help reduce the spin rate of the golf ball, it would be advantageous to design a core having a greater hardness gradient between the center and core surface than the gradients currently used in the art such that the spin rate of the golf ball can be further reduced while maintaining sufficient impact durability and resilience.

SUMMARY OF THE INVENTION

The problems expounded above, as well as others, are addressed by the following inventions, although it is to be understood that not every embodiment of the inventions described herein will address each of the problems described above.

In some embodiments, the present disclosure provides a golf ball including a core and a cover layer disposed over the core, the core having a center and a skin disposed about the center, wherein the core is formed from a rubber formulation cured under infrared radiation, the rubber formulation including a base rubber, a water releasing agent including a metal salt hydrate. In further embodiments, the skin may have a hardness that is at least 2 Shore C harder than any point in the center.

In one embodiment, the skin has a depth that is between about 0.005 and 0.04 inches. In another embodiment, the skin has a depth that is less than 0.01 inch. In yet another embodiment, the skin hardness is at least 5 Shore C harder than any point in the center. In a further embodiment, the water releasing agent is present in the rubber composition in an amount of about 1 to about 3 parts per hundred rubber.

In still another embodiment, the center further includes a geometric center having a first hardness, the skin includes a surface having a second hardness greater than the first hardness, and the first hardness ranges from about 50 Shore C to about 85 Shore C and the second hardness ranges from about 65 Shore C to about 100 Shore C. In another embodiment, the core possesses a hardness gradient substantially equal to the difference in the first hardness and the second hardness, wherein the hardness gradient is at least 30 Shore C. In still another embodiment, the rubber formulation further includes a compression agent. In a further embodiment, the base rubber comprises polybutadiene rubber, butyl rubber, EPDM rubber, or a blend thereof. In yet another embodiment, the cover layer comprises a material selected from the group consisting of polyurethanes, polyureas, and hybrids, copolymers, and blends thereof.

In other embodiments, the present disclosure provides a golf ball including a multi-layer core and a cover layer disposed about the core, the core including a center and an outer core layer disposed about the center, the outer core layer having a skin forming an exterior of the outer core layer and having a hardness that is at least 2 Shore C harder than any point in the center, wherein the outer core layer is formed from a rubber formulation cured under infrared radiation, the rubber formulation comprising a base rubber and a water releasing agent.

In one embodiment, the skin has a depth that is between about 0.005 and 0.04 inches. In another embodiment, the skin has a depth that is less than 0.01 inch. In a further embodiment, the center further comprises a geometric center having a first hardness, the skin comprises a surface having a second hardness greater than the first hardness, the core possesses a hardness gradient substantially equal to the difference in the first hardness and the second hardness, and the hardness gradient is at least 30 Shore C In still other embodiments, the present disclosure provides a golf ball including a core and a cover layer disposed about the core, the core including: a center having a geometric center hardness $H_C$, a skin disposed about the center and including a surface having a surface hardness $H_S$, and a hardness gradient $H_{Gr}$ equal to the difference between $H_C$ and $H_S$, wherein the core is formed from a rubber formulation comprising a base rubber and a metal salt hydrate having a water releasing agent concentration, $WRA_C$, and waters of hydration, $WRA_{WOH}$, wherein $H_{Gr}$ is equal to or greater than 30 Shore C, wherein $H_S$ is at least 2 Shore C harder than any point in the center, and wherein $$1 \leq \frac{WRA_C * WRA_{WOH}}{1 - \frac{1}{H_{Gr}}} \leq 22.$$

In another embodiment, $$2 \leq \frac{WRA_C * WRA_{WOH}}{1 - \frac{1}{H_{Gr}}} \leq 16.$$

In yet another embodiment, $$2 \leq \frac{WRA_C * WRA_{WOH}}{1 - \frac{1}{H_{Gr}}} \leq 7.$$

In still another embodiment, $$0.5 \leq \frac{WRA_{WOH}}{1 - \frac{1}{H_{Gr}}} < 10.$$

In a further embodiment, $$1 \leq \frac{WRA_{WOH}}{1 - \frac{1}{H_{Gr}}} \leq 7.5.$$

In yet another embodiment, the skin has a depth that is between about 0.005 and 0.04 inches.

In further embodiments, the present disclosure provides a method of forming a golf ball core including the steps of: providing a core comprising a rubber formulation comprising a base rubber and a water releasing agent, wherein the water releasing agent is a metal salt hydrate, and heating the core using infrared radiation, wherein after the step of heating the core using infrared radiation, the golf ball core comprises a skin having a hardness that is at least 2 Shore C harder than the rest of the core. In one embodiment, the step of heating the golf ball core using infrared radiation further comprises heating the core at a temperature between about 150° F. to about 560° F. for about 0.5 to about 5 minutes. In another embodiment, the step of forming the rubber formulation into the core further comprises compression molding the rubber formulation into the core at a temperature of about 300° F. to about 350° F. for about 4 to about 9 minutes. In still another embodiment, the skin has a depth that is between about 0.005 and 0.04 inches thick. In a further embodiment, the depth of the skin is less than 0.01 inch. In yet another embodiment, the skin hardness is at least 5 Shore D harder than the rest of the core.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
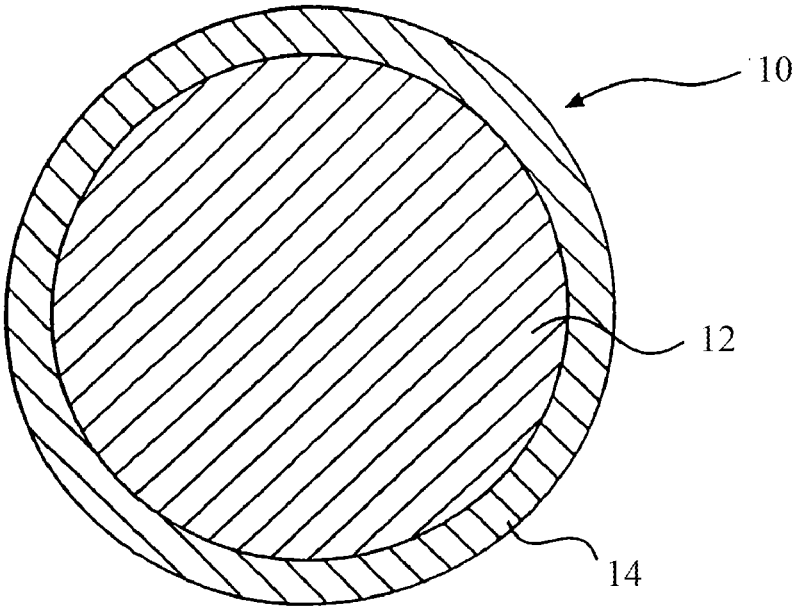
FIG. 1 is a cross-sectional view of a two-piece golf ball in accordance with an embodiment of the present disclosure.

The present disclosure relates to compositions and methods that may be used to produce a core with a high hardness gradient, cores including such compositions and/or made using such methods that possess a high hardness gradient, and golf balls including such cores. In some respects, the high hardness gradient cores made in accordance with the present disclosure provides the ability to reduce driver spin when compared to a conventional golf ball hit under the same conditions. In addition, the high hardness gradient cores made in accordance with the present disclosure may be used in golf balls to provide reduced shot dispersion on long shots as well as greater control on approach shots and greenside play.

While the golf ball core is functionally different from the other layers of the golf ball and operates somewhat independently, cores formed in accordance with the present disclosure greatly influence the overall performance of the finished golf ball including such a core. Without being bound by any particular theory, since a core typically represents about 90 percent of the golf ball weight, performance characteristics of a finished golf ball that contains the core of the present disclosure may be tailored by changing the core formulation and/or the curing process. For example, altering the core formulation and/or curing process and, thus, the hardness gradient, may have a significant effect on long shots, e.g., shots off of a driver, and approach shots, e.g., shots made with irons and wedges. In fact, adjusting the hardness gradient of cores made in accordance with this present disclosure, even in relatively small amounts, can significantly affect how a golf ball performs on long and short distance shots. Similarly, adjusting the hardness gradient of the core may allow for tailoring of other properties of the finished golf ball. The core formulations, cores, golf balls, and resulting performance characteristics are discussed in greater detail below.

Core Formulations

The present disclosure provides golf balls having single- or multi-layered cores made from core formulations that result in high hardness gradients across the core. In some embodiments, the core formulations of the present disclosure include a base rubber, a water releasing agent, a cross-linking agent, and a free radical initiator. The core formulations may also include a hardening agent and/or a compression agent. The core formulations may also optionally include additives, such as one or more of a metal oxide, metal fatty acid or fatty acid, antioxidant, soft and fast agent, or fillers. Concentrations of components are in parts per hundred (phr) unless otherwise indicated. As used herein, the term, "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

Base Rubber

As briefly discussed above, the core formulations of the present disclosure include a base rubber. In some embodiments, the base rubber may include natural and synthetic rubbers and combinations of two or more thereof. Examples of natural and synthetic rubbers suitable for use as the base rubber include, but are not limited to, polybutadiene, polyisoprene, ethylene propylene rubber (EPR), ethylene-propylene-diene (EPDM) rubber, grafted EPDM rubber, styrene-butadiene rubber, styrenic block copolymer rubbers (such as "SI", "SIS", "SB", "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

For example, the core may be formed from a core formulation that includes polybutadiene as the base rubber. Polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. In one embodiment, a transition metal complex (for example, neodymium, nickel, or cobalt) or an alkyl metal such as alkyl lithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. For example, the polybutadiene rubber may have a 1,4 cis-bond content of at least 40 percent. In another embodiment, the polybutadiene rubber has a 1,4 cis-bond content of greater than 80 percent. In still another embodiment, the polybutadiene rubber has a 1,4 cis-bond content of greater than 90 percent. In general, polybutadiene rubbers having a high 1,4 cis-bond content have high tensile strength and rebound.

The polybutadiene rubber may have a relatively high or low Mooney viscosity. Generally, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in U.S. Pat. Nos. 6,982,301 and 6,774,187, the disclosures of which are hereby incorporated by reference, and used in accordance with the present disclosure. In general, the lower limit of Mooney viscosity may be about 30 or 35 or 40 or 45 or 50 or 55 or 60 or 70 or 75 and the upper limit may be about 80 or 85 or 90 or 95 or 100 or 105 or 110 or 115 or 120 or 125 or 130. For example, the polybutadiene used in the core formulation may have a Mooney viscosity of about 30 to about 80 or about 40 to about 60.

Examples of commercially available polybutadiene rubbers that can be used in rubber formulations in accordance with the present disclosure, include, but are not limited to, BR 01 and BR 1220, available from BST Elastomers of Bangkok, Thailand; PR-040G, available from CHIMEI Corporation of Tainan City, Taiwan; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

In another embodiment, the core is formed from a rubber formulation including butyl rubber. Butyl rubber is an elastomeric copolymer of isobutylene and isoprene. Butyl rubber is an amorphous, non-polar polymer with good oxidative and thermal stability, good permanent flexibility, and high moisture and gas resistance. Generally, butyl rubber includes copolymers of about 70 percent to about 99.5 percent by weight of an isoolefin, which has about 4 to 7 carbon atoms, for example, isobutylene, and about 0.5 percent to about 30 percent by weight of a conjugated multiolefin, which has about 4 to 14 carbon atoms, for example, isoprene. The resulting copolymer contains about 85 percent to about 99.8 percent by weight of combined isoolefin and about 0.2 percent to about 15 percent of combined multiolefin. A commercially available butyl rubber suitable for use in rubber formulations in accordance with the present disclosure includes Bayer Butyl 301 manufactured by Bayer AG.

The rubber formulations may include a combination of two or more of the above-described rubbers as the base rubber. In some embodiments, the rubber formulation of the present disclosure includes a blend of different polybutadiene rubbers. In this embodiment, the rubber formulation may include a blend of a first polybutadiene rubber and a second polybutadiene rubber in a ratio of about 5:95 to about 95:5. For example, the rubber formulation may include a first polybutadiene rubber and a second polybutadiene rubber in a ratio of about 10:90 to about 90:10 or about 15:85 to about 85:15 or about 20:80 to about 80:20 or about 30:70 to about 70:30 or about 40:60 to about 60:40. In other embodiments, the rubber formulation may include a blend of more than two polybutadiene rubbers or a blend of polybutadiene rubber(s) with any of the other elastomers discussed above.

In other embodiments, the rubber formulation used to form the core includes a blend of polybutadiene and butyl rubber. In this embodiment, the rubber formulation may include a blend of polybutadiene and butyl rubber in a ratio of about 10:90 to about 90:10. For example, the rubber formulation may include a blend of polybutadiene and butyl rubber in a ratio of about 10:90 to about 90:10 or about 20:80 to about 80:20 or about 30:70 to about 70:30 or about 40:60 to about 60:40. In other embodiments, the rubber formulation may include polybutadiene and/or butyl rubber in a blend with any of the other elastomers discussed above.

In further embodiments, the rubber formulation used to form the core may include EPDM or grafted EPDM as the base rubber. The EPDM rubber may be any commercially available EPDM rubber, for example, Dow Nordel® IP 5565 EPDM. In still further embodiments, the core formulations may include a combination of EPDM rubber and grafted EPDM rubber as the base rubber. In other embodiments, the rubber formulation may include a blend of polybutadiene rubber or butyl rubber and EPDM rubber and/or grafted EPDM rubber as the base rubber. In still further embodiments, the rubber formulation may include a blend of polybutadiene rubber or butyl rubber and EPDM rubber as the base rubber. In this embodiment, the rubber formulation may include a blend of EPDM rubber and polybutadiene rubber or butyl rubber in a ratio of about 10:90 to about 90:10. For example, the rubber formulation may include a blend of EPDM rubber and polybutadiene rubber or butyl rubber in a ratio of about 10:90 to about 90:10 or about 20:80 to about 80:20 or about 30:70 to about 70:30 or about 40:60 to about 60:40. In still further embodiments, the base rubber may include a blend of EPDM rubber and two or more different other types of rubber, such as a combination of polybutadiene rubber and butyl rubber or two or more different types polybutadiene rubber or butyl rubber.

The rubber formulations include the base rubber in an amount of 100 phr. That is, when more than one rubber component is used in the rubber formulation as the base rubber, the sum of the amounts of each rubber component should total 100 phr. In some embodiments, the rubber formulations include polybutadiene rubber as the base rubber in an amount of 100 phr. In other embodiments, the rubber formulations include polybutadiene rubber and a second rubber component. In one such embodiment, the polybutadiene rubber may be used in an amount of about 40 to about 99 parts by weight per 100 parts of the total rubber and the second rubber component may be used in an amount of about 1 to about 60 parts by weight per 100 parts of the total rubber. In another embodiment, the polybutadiene rubber may be used in an amount of about 80 to about 98 parts by weight per 100 parts of the total rubber and the second rubber component may be used in an amount of about 2 to about 20 parts by weight per 100 parts of the total rubber. In still another embodiment, the polybutadiene rubber may be used in an amount of about 85 to about 97 parts by weight per 100 parts of the total rubber and the second rubber component may be used in an amount of about 3 to about 15 parts by weight per 100 parts of the total rubber. In yet another embodiment, the polybutadiene rubber may be used in an amount of about 90 to about 99 parts by weight per 100 parts of the total rubber and the second rubber component may be used in an amount of about 1 to about 10 parts by weight per 100 parts of the total rubber. In a further embodiment, the polybutadiene rubber may be used in an amount of about 94 to about 96 parts by weight per 100 parts of the total rubber and the second rubber component may be used in an amount of about 4 to about 6 parts by weight per 100 parts of the total rubber. In some embodiments, the second rubber component is EPDM rubber.

The base rubber may be used in the rubber formulation in an amount of at least about 5 percent by weight based on total weight of the rubber formulation. In some embodiments, the base rubber is included in the rubber formulation in an amount within a range having a lower limit of about 10 percent or 20 percent or 30 percent or 40 percent or 50 percent or 55 percent and an upper limit of about 60 percent or 70 percent or 80 percent or 90 percent or 95 percent or 100 percent. For example, the base rubber may be present in the rubber formulation in an amount of about 30 percent to about 80 percent by weight based on the total weight of the rubber formulation. In another example, the rubber formulation includes about 40 percent to about 70 percent base rubber based on the total weight of the rubber formulation.

Hardening Agent

The rubber formulations of the present disclosure include a hardening agent. Without being bound to any particular theory, the hardening agent may affect the hardness of the core and the hardness gradient across the core. Suitable hardening agents include, but are not limited to, benzoic compounds comprising a nitro functional group and one of a hydroxyl, amino, or sulfhydryl functional group. Nonlimiting examples of hardening agents include nitrophenol, nitroaniline, and nitrothiophenol. Different isomers of the hardening agent may be used such as, for example, 2-nitrophenol, 3-nitrophenol, 4-nitrophenol, 2-nitroaniline, 3-nitroaniline, 4-nitroaniline, 2-nitrothiophenol, 3-nitrothiophenol, 4-nitrothiophenol, and combinations thereof. Without being bound by any particular theory, different isomers of the hardening agent may affect the hardness of the core differently and produce different hardness gradients across the core. Some hardening agents, such as nitrophenol, may be advantageous because they are safe and/or easy to handle during manufacturing.

The hardening agent may be included in the rubber formulation in varying amounts depending on the desired characteristics of the golf ball core. For example, the hardening agent may be used in an amount of 0.01 to about 3 parts by weight per 100 parts of the total rubber. In one embodiment, the rubber formulation of the core includes about 0.05 to about 1.5 or about 0.1 to about 1 or about 0.1 to 0.5 parts by weight hardening agent per 100 parts of the total rubber. In another embodiment, the hardening agent is included in the rubber formulation in an amount of about 0.2 to about 0.7 parts by weight per 100 parts of the total rubber. In still another embodiment, the rubber formulation includes about 0.05 to about 0.3 or 0.2 to about 0.4 or about 0.3 to about 0.5 or about 0.4 to about 0.6 parts by weight hardening agent per 100 parts of the total rubber.

In some respects, the amount of hardening agent in the rubber formulation required to produce the desired hardness gradient may differ based on the compound, and even the particular isomer of the compound, used as the hardening agent. For example, when the rubber formulation includes 2-nitrophenol, which has a nitro functional group ortho to a hydroxyl functional group, the hardening agent may be used in an amount of about 0.1 to about 0.3 parts by weight per 100 parts of the total rubber to achieve the desired hardness gradient. In other embodiments, when the rubber formulation includes 3-nitrophenol, which has a nitro functional group meta to a hydroxyl functional group, the hardening agent may be used in an amount of about 0.2 to about 0.4 parts by weight per 100 parts of the total rubber to achieve the desired hardness gradient. In further embodiments, when the rubber formulation includes 4-nitrophenol, which has a nitro functional group para to a hydroxyl functional group, the hardening agent may be used in an amount of about 0.3 to about 0.5 parts by weight hardening agent per 100 parts of the total rubber to achieve the desired hardness gradient. Without being bound by any particular theory, the relative positions of the functional groups on disubstituted benzoic hardening agents are believed to influence the effectiveness of the compound as a hardening agent. Accordingly, the amount of hardening agent needed to produce a desired hardness gradient may change when different isomers within a class of compounds are used.

Compression Agent

The rubber formulations of the present disclosure may include a compression agent. Without being bound to any particular theory, including a compression agent in the rubber formulation of a golf ball core may increase the compression and COR of the golf ball core as well as the hardness gradient of the golf ball core. The compression agent may also be aromatic or aliphatic in nature. As discussed in greater detail below, some compression agents may have increased activity when the rubber formulation also includes a water releasing agent.

In some embodiments, the compression agent is a polyfunctional isocyanate. A polyfunctional isocyanate is an organic compound having two or more isocyanate (—NCO) groups per molecule and may include monomers, polymers, quasi prepolymers, or prepolymers. In some aspects, the compression agent may be a monomeric polyfunctional isocyanate, a polymeric polyfunctional isocyanate, or a blend thereof. The polyfunctional isocyanate may be aromatic or aliphatic in nature. Nonlimiting examples of polyfunctional isocyanates for use as the compression agent with the present invention include methylene diphenyl diisocyanate ("MDI") and isomers thereof including 4,4'-diphenylmethane diisocyanate ("4,4'-MDI"), polymeric MDI, carbodiimide-modified liquid MDI, 4,4'-dicyclohexylmethane diisocyanate ("H12MDI"), polymethylene polyphenlisocyante containing MDI, p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); p-methylxylene diisocyanate; m-methylxylene diisocyanate; o-methylxylene diisocyanate; para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; naphthalene diisocyanate; anthracene diisocyanate; and combinations thereof. In one embodiment, the compression agent is a polymethylene polyphenylisocyanate containing MDI. A non-limiting example of a commercially available polyfunctional isocyanate includes PAPI® 94 manufactured by The Dow Chemical Company.

The compression agent may be included in the rubber formulation in varying amounts depending on the desired characteristics of the golf ball core. For example, the compression agent may be used in an amount of 0.1 to about 10 parts by weight per 100 parts of the total rubber. In one embodiment, the rubber formulation of the core includes about 0.2 to about 7 parts by weight polyfunctional isocyanate per 100 parts of the total rubber. In another embodiment, the polyfunctional isocyanate is included in the rubber formulation in an amount of about 0.5 to about 5 or about 0.5 to about 2 or about 0.7 to about 1.3 parts by weight per 100 parts of the total rubber. In yet another embodiment, the rubber formulation includes 0.6 to about 0.9 or about 0.8 to about 1.2 or about 1.1 to about 1.6 parts by weight polyfunctional isocyanate per 100 parts of the total rubber.

Water Releasing Agent

The core rubber formulations of the present disclosure include a water releasing agent. A "water releasing agent," as used herein, refers to a compound having at least one water molecule available for release during the curing process. When the free radical initiator decomposes to generate decomposition heat at the time of curing of the core, the temperature near the surface of the core is kept substantially the same as the temperature of the mold, while the temperature near the center of the core increases because of the accumulated decomposition heat of the free radical initiator. Without being bound by any particular theory, it is believed that, by adding a water releasing agent to the core rubber formulation that can release water at the desired curing temperature, the water can promote further decomposition of the free radical initiator and deactivation of radicals at the center of the core, which, in turn, results in a difference in crosslinking density and an increased hardness gradient between the center and the surface.

The water releasing agent of the present disclosure has a moisture content capable of releasing a sufficient amount of water to promote decomposition of the free radical initiator and deactivation of radicals during the curing process. The moisture content in the water releasing agent can be calculated as the mass of water in the water releasing agent divided by the total weight of the water releasing agent. In some embodiments, the water releasing agent has a moisture content (in its molecular form) of at least about 5 percent by mass. In further embodiments, the water releasing agent has a moisture content ranging from about 5 percent by mass to about 95 percent by mass. In still further embodiments, the water releasing agent has a moisture content ranging from about 10 percent by mass to about 90 percent by mass. In yet further embodiments, the water releasing agent has a moisture content ranging from about 15 percent by mass to about 85 percent by mass. In further embodiments, the water releasing agent has a moisture content of at least about 50 percent by mass. For example, the water releasing agent may have a moisture content of about 50 percent by mass to about 95 percent by mass.

In some embodiments, the water releasing agent of the present disclosure may be a metal sulfate hydrate having one or more waters of hydration capable of being released during the reactions of the present disclosure. In one embodiment, the metal may be an alkaline earth metal. For example, the metal may be calcium, magnesium, beryllium, strontium, barium, or radium. In another embodiment, the metal of the metal sulfate hydrate is calcium. In yet another embodiment, the metal of the metal sulfate hydrate is magnesium. In further embodiments, the metal may be a transition metal or a post-transition metal. For instance, the metal may be zinc, copper, iron, cobalt, manganese, chromium, nickel, aluminum, zirconium, cadmium, indium, or vanadium. In still further embodiments, the metal may be neodymium or lanthanum.

The metal sulfate hydrate may have any number of waters of hydration. In some embodiments, the metal sulfate hydrate may have from 0.5 to ten waters of hydration. For instance, the metal sulfate hydrate may be a hemihydrate, monohydrate, dihydrate, trihydrate, tetrahydrate, pentahydrate, hexahydrate, heptahydrate, octahydrate, nonahydrate, or decahydrate. In further embodiments, the metal sulfate hydrate may have from one to seven waters of hydration. In still further embodiments, the metal sulfate hydrate may have from one to four waters of hydration. In yet further embodiments, the metal sulfate hydrate may have from one to three waters of hydration. In other embodiments, the metal sulfate hydrate may have two waters of hydration. For example, in one embodiment, the metal sulfate hydrate may be a dihydrate. In still further embodiments, the metal sulfate hydrate may be a heptahydrate (i.e., having seven waters of hydration).

Examples of suitable metal sulfate hydrates contemplated for use as the water releasing agent in accordance with the present disclosure include, but are not limited to, calcium sulfate hemihydrate ($CaSO_4 \cdot 0.5H_2O$) calcium sulfate dihydrate ($CaSO_4 \cdot 2H_2O$), magnesium sulfate heptahydrate ($MgSO_4 \cdot 7H_2O$), zinc sulfate dihydrate ($ZnSO_4 \cdot 2H_2O$), zinc sulfate heptahydrate ($ZnSO_4 \cdot 7H_2O$), vanadium oxide sulfate hydrate ($VOSO_4 \cdot xH_2O$), neodymium sulfate hydrate ($Nd_2(SO_4)_3 \cdot xH_2O$), lanthanum oxalate hydrate ($La_2(C_2O_4)_3 \cdot xH_2O$), zinc sulfate monohydrate ($ZnSO_4 \cdot H_2O$), zirconium sulfate hydrate ($Zr(SO_4)_2 \cdot xH_2O$), beryllium sulfate tetrahydrate ($BeSO_4 \cdot 4H_2O$), manganese sulfate hydrate ($MnSO_4 \cdot xH_2O$), iron sulfate hydrate ($FeSO_4 \cdot xH_2O$), cobalt sulfate hydrate ($CoSO_4 \cdot xH_2O$), cadmium sulfate monohydrate ($CdSO_4 \cdot H_2O$), cadmium sulfate octahydrate ($CdSO_4 \cdot 8H_2O$), indium sulfate nonahydrate ($InSO_4 \cdot 9H_2O$), nickel sulfate heptahydrate ($NiSO_4 \cdot 7H_2O$), nickel sulfate hexahydrate ($NiSO_4 \cdot 6H_2O$), aluminum sulfate hydrate ($Al_2(SO_4)_3 \cdot xH_2O$), and copper sulfate pentahydrate ($CuSO_4 \cdot 5H_2O$). In some embodiments, the water releasing agent is a metal sulfate dihydrate such as calcium sulfate dihydrate and zinc sulfate dihydrate.

The water releasing agent may be included in the rubber formulation in varying amounts depending on the desired characteristics of the golf ball core. For example, the water releasing agent may be used in an amount of 0.1 to about 15 or about 0.5 to about 10 or about 1 to about 8 parts by weight water releasing agent per 100 parts of the total rubber. In one embodiment, the rubber formulation of the core includes about 0.2 to about 6 parts by weight water releasing agent per 100 parts of the total rubber. In some embodiments, the water releasing agent is included in the rubber formulation in an amount of about 2 to about 10 or about 3 to about 8 or about 3 to about 6 or about 5 to about 8 parts by weight water releasing agent per 100 parts of the total rubber. In other embodiments, the water releasing agent is included in the rubber formulation in an amount of about 0.5 to about 4 or about 0.7 to about 3.5 or about 1 to about 3 parts by weight water releasing agent per 100 parts of the total rubber. In yet further embodiments, the rubber formulation includes about 0.7 to about 1.4 or about 1.3 to about 1.7 or about 1.6 to about 2.3 or about 2.2 to about 3 parts by weight water releasing agent per 100 parts of the total rubber. For example, in some embodiments, the water releasing agent is present in the core rubber formulation in an amount of about 2 parts by weight water releasing agent per 100 parts of the total rubber.

In some respects, the amount of water releasing agent in the rubber formulation may differ based on the compound used as the water releasing agent. In particular, the amount of water releasing agent included may depend on the moisture content and moisture availability in the water releasing agent. When the water releasing agent has a greater moisture content, less water releasing agent may be needed in the rubber formulation to give the golf ball core the desired performance characteristics. For example, more water releasing agent may be required when the water releasing agent is calcium sulfate dihydrate, which has a moisture content of approximately 21 percent, than if water releasing agent is magnesium sulfate heptahydrate, which has a moisture content of about 51 percent. The moisture availability refers to how readily the water molecules dissociate from the water releasing agent. If the water releasing agent used has a high moisture availability, less water releasing agent may be needed than if the water releasing agent has a low moisture availability. Further, the amount of water releasing agent in the rubber formulation may differ based on the amount, type, or both of the hardening agent or the compression agent.

The core formulations may include two or more of any of the water releasing agents described above. For example, the core formulations may include two or more of any of the metal sulfate hydrates described above. In some embodiments, it may be desirable to formulate the rubber formulation of the golf ball core based on the water content of the rubber formulation instead of or in addition to the concentration of the water releasing agent. In this aspect, the water content of the rubber formulation can be determined by multiplying the concentration of water releasing agent in parts by weight per 100 parts of the total rubber by the moisture content of the water releasing agent. For example, if the water releasing agent is included in the rubber formulation at about 2 parts by weight per 100 parts of the total rubber and the moisture content in the water releasing agent is 50 percent, the water content of the rubber formulation is 1 part by weight per 100 parts of the total rubber. As such, the desired or targeted water content of the rubber formulation may be used to determine the concentration (and/or type) of water releasing agent used.

In some embodiments, the rubber formulation has a water content of about 0.01 to about 10 or about 0.05 to about 7 or about 0.1 to about 5 parts by weight water per 100 parts of the total rubber. In other embodiments, the water content of the rubber formulation is about 0.1 to about 2.5 or about 0.2 to about 2 or about 0.5 to about 1.5 parts by weight per 100 parts of the total rubber. In other embodiments, the water content of the rubber formulation is about 0.05 to about 1 or about 0.1 to about 0.5 or about 0.2 to about 0.6 parts by weight per 100 parts of the total rubber. In further embodiments, the rubber formulation has a water content of about 1 to about 3 or about 1.5 to about 2.5 or about 1 to about 2 parts by weight per 100 parts of the total rubber.

In addition, the amount of water releasing agent used in the rubber formulation may affect the amount of hardening agent or compression agent when a hardening agent or compression agent is included in the rubber formulation. More specifically, when included in the rubber formulation, the water releasing agent itself may affect the hardness gradient and, thus, may allow less hardening agent or compression agent to be employed. For example, when the water releasing agent is included in an amount of about 1 to about 8 parts by weight, the hardening agent may be included in an amount of about 0.05 to about 0.6 parts by weight per 100 parts of the total rubber. In the alternative, when the water releasing agent is included in an amount of about 0.1 to about 5 parts by weight, the hardening agent may be included in an amount of about 0.3 to about 1.5 parts by weight per 100 parts of the total rubber.

Crosslinking Co-Agent

The rubber formulations further include a reactive crosslinking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. In one embodiment, the co-agent is one or more metal salts of acrylates, diacrylates, methacrylates, and dimethacrylates, wherein the metal is selected from magnesium, calcium, zinc, aluminum, lithium, and nickel. In another embodiment, the co-agent includes one or more zinc salts of acrylates, diacrylates, methacrylates, and dimethacrylates. For example, the co-agent may be zinc diacrylate (ZDA). In another embodiment, the co-agent may be zinc dimethacrylate (ZDMA). An example of a commercially available zinc diacrylate includes Dymalink® 526 manufactured by Cray Valley.

The co-agent may be included in the rubber formulation in varying amounts depending on the desired characteristics of the golf ball core. For example, the co-agent may be used in an amount of about 5 to about 50 or about 10 to about 45 or about 15 to about 40 parts by weight per 100 parts of the total rubber. In one embodiment, the rubber formulation of the core includes about 35 to about 48 parts by weight co-agent per 100 parts of the total rubber. In another embodiment, the rubber formulation includes about 38 to about 45 or about 39 to about 42 parts by weight co-agent per 100 parts of total rubber. In another embodiment, the co-agent is included in the rubber formulation of the core in an amount of about 29 to about 37 or about 31 to about 35 parts by weight per 100 parts of the total rubber. In still another embodiment, the rubber formulation includes about 25 to about 33 or about 27 to about 31 parts by weight co-agent per 100 parts of the total rubber.

In some respects, the amount of co-agent in the rubber formulation may be altered based on the class of compounds, and the particular isomer within a class of compounds, used as the hardening agent. For example, when the rubber formulation includes 2-nitrophenol, the co-agent may be included in the rubber formulation in amount from about 37 to about 43 or about 39 to about 41 parts by weight per 100 parts of the total rubber. In another example, when the rubber formulation includes 3-nitrophenol, the co-agent may be included in the rubber formulation in amount from about 30 to about 36 or about 32 to about 34 parts by weight per 100 parts of the total rubber. In yet another example, when the rubber formulation includes 4-nitrophenol, the co-agent may be included in the rubber formulation in amount from about 26 to about 32 or about 28 to about 30 parts by weight per 100 parts of the total rubber. Without being bound to any particular theory, the concentration of co-agent may be altered to achieve the desired compression of the golf ball core when different hardening agents are used.

In other respects, the amount of co-agent in the rubber formulation may be altered based on the amount and type of compression agent and/or water releasing agent included in the rubber formulation. For example, when the rubber formulation includes higher concentrations of compression agent and/or water releasing agent or a more active compression agent and/or water releasing agent, a lower concentration of co-agent may be used. For example, in prior art golf ball cores that do not include a compression agent and a water releasing agent, the co-agent may be included in the rubber formulation in amount from about 40 to about 50 parts by weight per 100 parts of the total rubber. In contrast, for a golf ball core of the present disclosure including a compression agent and/or a water releasing agent, the rubber formulation may include about 20 to about 35 parts co-agent by weight per 100 parts of the total rubber. In one embodiment, the co-agent may be included in an amount of about 20 to about 30 parts by weight per 100 parts of the total rubber. In another embodiment, the rubber formulation may include about 25 to about 35 parts by weight of the co-agent per 100 parts of the total rubber. In still another embodiment, the co-agent may be included in the rubber formulation in an amount of about 22 to about 28 parts by weight of the total rubber. Without being bound to any particular theory, the reduced need for co-agent in the rubber formulation may reduce the cost of manufacturing golf balls that include the golf ball core of the present disclosure.

Free Radical Initiator

The core formulations may include a free radical initiator selected from an organic peroxide, a high energy radiation source capable of generating free radicals, or a combination thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BD-FF, commercially available from Akzo Nobel. In other embodiments, the free radical initiator is dimethyl terbutyl peroxide, including, but not limited to Trigonox® 101-50D-PD, commercially available from Nouryon.

Free radical initiators may be present in the rubber formulation in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubber, and an upper limit of 2.5 parts or 3 parts or 5 parts or 6 parts or 10 parts or 15 parts by weight per 100 parts of the total rubber. For example, the rubber formulation may include peroxide free radical initiators in an amount of about 0.1 to about 10 or about 0.5 to about 6 or about 1 to about 5 parts by weight per 100 parts of the total rubber. In another example, the rubber formulation may include peroxide free radical initiators in an amount of about 0.5 to about 2 or about 0.7 to about 1.8 or about 0.8 to about 1.2 or about 1.3 to about 1.7 parts by weight per 100 parts of the total rubber. In yet another example, the rubber formulation may include peroxide free radical initiators in an amount of about 1.5 to about 3 or about 1.7 to about 2.8 or about 1.8 to about 2.2 or about 2.3 to about 2.7 parts by weight per 100 parts of the total rubber.

Additives

Radical scavengers such as a halogenated organosulfur, organic disulfide, or inorganic disulfide compounds may also be added to the rubber formulation. In one embodiment, a halogenated organosulfur compound included in the rubber formulation includes, but is not limited to, pentachlorothiophenol (PCTP) and salts of PCTP such as zinc pentachlorothiophenol (ZnPCTP). In another embodiment, ditolyl disulfide, diphenyl disulfide, dixylyl disulfide, 2-nitroresorcinol, and combinations thereof are added to the rubber formulation. An example of a commercially available radical scavenger includes Rhenogran® Zn-PTCP-72 manufactured by Rheine Chemie. The radical scavenger may be included in the rubber formulation in an amount of about 0.3 to about 1 part by weight per 100 parts of the total rubber. In one embodiment, the rubber formulation may include about 0.4 to about 0.9 parts by weight radical scavenger per 100 parts of the total rubber. In another embodiment, the rubber formulation may include about 0.5 to about 0.8 parts by weight radical scavenger per 100 parts of the total rubber.

The rubber formulation may also include filler(s). Suitable non-limiting examples of fillers include carbon black, clay and nanoclay particles, talc, glass (e.g., glass flake, milled glass, and microglass), mica and mica-based pigments (e.g., Iriodin® pearl luster pigments from The Merck Group), and combinations thereof. Metal oxide and metal sulfate fillers are also contemplated for inclusion in the rubber formulation. Suitable metal fillers include, for example, particulate, powders, flakes, and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof. Suitable metal oxide fillers include, for example, zinc oxide, iron oxide, aluminum oxide, titanium oxide, magnesium oxide, and zirconium oxide. Suitable metal sulfate fillers include, for example, barium sulfate and strontium sulfate. When included, the fillers may be in an amount of about 1 to about 25 parts by weight per 100 parts of the total rubber. In one embodiment, the rubber formulation includes at least one filler in an amount of about 5 to about 20 or about 8 to about 15 parts by weight per 100 parts of the total rubber. In another embodiment, the rubber formulation includes at least one filler in an amount of about 8 to about 14 or about 10 to about 12 parts by weight per 100 parts of the total rubber. In yet another embodiment, the rubber formulation includes at least one filler in an amount of about 10 to about 17 or about 12 to about 15 parts by weight per 100 parts of the total rubber. In yet another embodiment, the rubber formulation includes at least one filler in an amount of about 10 to about 16 or about 12 to about 15 parts by weight per 100 parts of the total rubber. In a further embodiment, the rubber formulation includes at least one filler in an amount of about 12 to about 18 or about 14 to about 16 parts by weight per 100 parts of the total rubber. An example of a commercially available barium sulfate filler includes PolyWate® 325 manufactured by Cimbar Performance Minerals.

In some aspects, the amount of filler in the rubber formulation may be altered based on the compound, and the particular isomer of the compound, used as the hardening agent. For example, when the rubber formulation includes 2-nitrophenol, at least one filler may be included in the rubber formulation in amount from about 9 to about 13 parts by weight per 100 parts of the total rubber. In another example, when the rubber formulation includes 3-nitrophenol, the filler may be included in the rubber formulation in amount from about 11 to about 16 parts by weight per 100 parts of the total rubber. In yet another example, when the rubber formulation includes 4-nitrophenol, the filler may be included in the rubber formulation in amount from about 13 to about 17 parts by weight per 100 parts of the total rubber.

In some respects, the amount of filler in the rubber formulation may be altered based on amount and type of compression agent and/or water releasing agent included in the rubber formulation. For example, when the rubber formulation includes higher concentrations of water releasing agent or a more active water releasing agent, a greater concentration of filler may be needed to produce a golf ball with the desired characteristics. Moreover, if a particular water releasing agent combination in the rubber formulation of a golf ball core has a particularly strong effect on the hardness gradient or the compression and COR of the core, a greater concentration of filler may be needed. For example, in prior art golf ball cores that do not include a water releasing agent, the filler may be included in the rubber formulation in amount from about 4 to about 10 parts by weight per 100 parts of the total rubber. In contrast, in golf balls of the present disclosure, the filler may be included in the rubber formulation, for example, in amount from about 13 to about 17 parts by weight per 100 parts of the total rubber.

In some embodiments, more than one type of filler may be included in the rubber formulation. For example, the rubber formulation may include a first filler in an amount from about 5 to about 20 or about 8 to about 17 parts by weight per 100 parts total rubber and a second filler in an amount from about 1 to about 10 or about 3 to about 7 parts by weight per 100 parts total rubber. In another example, the rubber formulation may include a first filler in an amount from about 7 to about 13 or about 9 to about 12 parts by weight per 100 parts total rubber and a second filler in an amount from about 2 to about 8 or about 4 to about 6 parts by weight per 100 parts total rubber. In yet another example, the rubber formulation may include a first filler in an amount from about 10 to about 15 or about 13 to about 14 parts by weight per 100 parts total rubber and a second filler in an amount from about 2 to about 9 or about 3 to about 7 parts by weight per 100 parts total rubber. In a further example, the rubber formulation may include a first filler in an amount from about 10 to about 15 or about 13 to about 14 parts by weight per 100 parts total rubber and a second filler in an amount from about 13 to about 18 or about 14 to about 16 parts by weight per 100 parts total rubber.

Antioxidants, processing aids, accelerators (for example, tetra methylthiuram), dyes and pigments, wetting agents, surfactants, plasticizers, coloring agents, fluorescent agents, chemical blowing and foaming agents, defoaming agents, stabilizers, softening agents, impact modifiers, antiozonants, as well as other additives known in the art, may also be added to the rubber formulation. Examples of suitable processing aids include, but are not limited to, high molecular weight organic acids and salts thereof. Suitable organic acids are aliphatic organic acids, aromatic organic acids, saturated mono-functional organic acids, unsaturated mono-functional organic acids, multi-unsaturated mono-functional organic acids, and dimerized derivatives thereof. In one embodiment, the organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, and dimerized derivatives thereof. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof.

Curing the Core Formulation

The materials used in forming the core formulation may be combined to form a mixture by any type of mixing known to one of ordinary skill in the art. Suitable types of mixing include single pass and multi-pass mixing, and the like. A single pass mixing process where ingredients are added sequentially is preferred, as this type of mixing tends to increase efficiency and reduce costs for the process. In embodiments where a free-radical initiator and hardening agent are included in the rubber formulation of the core, it may be desirable to combine the hardening agent into the rubber formulation prior to adding the free-radical initiator.

The rubber formulation may be cured using infrared (IR) curing processes. IR curing processes use IR radiation to heat and cure the rubber formulation to form a golf ball core. IR radiation is generally split into three wavelengths: short-wave, medium-wave, and long-wave. The wavelengths can vary from 0.7 microns to about 1000 microns. Generally, short-wave IR radiation is considered to be about 0.7 to about 1.5 microns, medium-wave IR radiation is considered to be about 1.5 to about 3 microns, and long-wave IR radiation is considered to be about 3 to about 1000 microns. There are a wide variety of IR heaters (i.e., emitters) for use in IR heating and curing that use different wavelengths of IR radiation. The type of emitter used to cure a golf ball core may affect the properties of the golf ball core. Generally, the type of IR radiation employed in accordance with the present disclosure is a medium-wave or long-wave IR radiation wherein the heater is bright red during operation. The absorption wavelengths of C=C groups, including those found in butadiene, is about 6.07 microns. The absorption wavelengths for most materials discussed in the present disclosure fall between about 5 to about 7 microns. IR heaters that output IR radiation in this range are well-known by those in the field and can be used to cure golf ball cores in accordance with the present disclosure.

The IR heater uses IR radiation to heat the surface and underlying mils of the golf ball core at temperatures ranging from less than 300° F. to up to 2000° F. The IR radiation heats the outer regions of the golf ball core to a higher temperature than the center of the core, thereby creating a temperature gradient within the core. This heating also creates a skin on the golf ball core, as discussed in greater detail below. The time of exposure and temperature of the IR heater determines the depth and degree of curing of the core.

The present disclosure provides a method of curing a golf ball core using IR heating. A golf ball core having a rubber formulation in accordance with the present disclosure may be provided. The golf ball core may be placed on a spindle which spins at a rate of 1 to 100 rotations per minute (rpm). In some implementations, the spindle may spin at a rate of about 1 to about 500 rpm or about 300 to about 700 rpm or about 500 to about 1000. In other implementations, the spindle may spin at a rate of about 1 to about 200 rpm or about 100 to about 400 rpm or about 300 to about 600 rpm or about 500 to about 800 rpm or about 700 to about 1000 rpm.

The rotating golf ball core may be passed near an IR heater. In some implementations, the golf ball core may be passed between two IR heaters disposed on opposite sides of the golf ball core. In other implementations, the golf ball core may be passed between three, four or more infrared heaters disposed on different sides of the golf ball core. In some implementations, the golf ball core may be disposed about 1 to about 12 inches or about 1 to about 6 inches or about 2 to about 5 inches or about 1 to about 4 inches from the IR heater. In other implementations, the golf ball core may be disposed about 2 to about 4 inches or about 2 to about 3 inches or about 3 to about 4 inches or about 2.5 to about 3.5 or about 2.5 to about 3 inches from the golf ball core. In implementations having two or more IR heaters, the golf ball core may be disposed at the same distance from each IR heater used or at different distances from different IR heaters. For example, a golf ball core undergoing the IR curing process may be disposed 2.5 inches from a first IR heater and 3 inches from a second IR heater. Without being bound to any particular theory, decreasing the distance between the IR heater and the golf ball core may increase the heating of the golf ball core, and as discussed below, increase the hardness gradient of the golf ball core.

The amount of time that the golf ball core is exposed to IR radiation from the IR heater (the "IR cure time") may vary depending on the desired performance characteristics of a golf ball including a golf ball core made in accordance with the present disclosure. In some implementations, the IR cure time is about 0.25 to about 10 minutes or about 0.5 to about 7.5 minutes or about 0.5 to about 5 minutes. In other implementations, the IR cure time is about 0.5 to about 4 minutes or about 1 to about 5 minutes or about 1 to about 4 minutes or about 2 to about 3 minutes. In still further implementations, the IR cure time is about 0.5 to about 3 minutes or about 1 to about 3 minutes or about 0.5 to about 2 minutes or about 1 to about 2 minutes. In yet other implementations, the IR cure time is about 2 to about 5 minutes or about 3 to about 4 minutes or about 4 to about 5 minutes or about 3.5 to about 4.5 minutes. Without being bound to any particular theory, increasing the IR cure time may increase the heating of the golf ball core, and as discussed below, increase the hardness gradient of the golf ball core.

The power level of the IR heater may be varied depending on the desired performance characteristics of a golf ball including a golf ball core made in accordance with the present disclosure. The power level of the IR heater may be discussed in terms of the percent of maximum power of the IR heater or in terms of the temperature of the surface of the IR heater. For example, the IR heater may be able to run from about 10 percent to about 100 percent power, which may correspond to temperature ranges of about 150° F. to about 560° F. In some implementations, the IR heater may be set to about 30 to about 100 percent power or about 50 to about 100 percent power or about 55 to about 90 percent power or about 60 to about 80 percent power or about 60 to about 70 percent power. In other implementations, the power level of the IR heater may be set such that the surface temperature of the IR heater ranges from about 200° F. to about 550° F. or about 200° F. to about 500° F. or about 300° F. to about 500° F. or about 200° F. to about 300° F. or about 300° F. to about 400° F. or about 400° F. to about 500° F. or about 250° F. to about 450° F. or about 250° F. to about 350° F. or about 350° F. to about 450° F. or about 400° F. to about 450° F. or about 400° F. to about 420° F. In implementations having two or more IR heaters, the IR heaters may be set at the same or different power levels. For example, a first IR heater may be set to a surface temperature of 450° F. and a second IR heater may be set to a surface temperature of 400° F. Without being bound to any particular theory, increasing the power level of one or more IR heaters used to cure the golf ball core may increase the heating of the golf ball core, and as discussed below, increase the hardness gradient of the golf ball core.

The power level of the IR heater is determined based on the desired temperature difference between the surface temperature of the IR heater and the surface temperature of the golf ball core at the beginning of being heated. For example, the temperature difference between the surface temperature of the IR heater and the surface temperature of the golf ball core may range from about 70° F. to about 480° F. In other implementations, the power level of the IR heater may be set such that the surface temperature of the IR heater ranges from about 100° F. to about 450° F. or about 100° F. to about 400° F. or about 200° F. to about 400° F. or about 100° F. to about 200° F. or about 200° F. to about 300° F. or about 300° F. to about 400° F. or about 150° F. to about 350° F. or about 150° F. to about 250° F. or about 250° F. to about 350° F. or about 300° F. to about 350° F. or about 300° F. to about 320° F. Without being bound to any particular theory, the temperature difference between the surface temperature of the IR heater and the surface temperature of the golf ball core affects the rate of heat transfer between the IR heater and the golf ball core and, in turn, the increase in the hardness gradient of the golf ball core.

The amount of heating and curing that the golf ball core undergoes, and the performance characteristics of a golf ball including such golf ball core, may depend on various parameters of the IR curing process including the distance between the golf ball core and the IR heater, the length of time that the golf ball core is exposed to the IR heater, and the power level of the IR heater. Accordingly, different combinations of these factors may be used to produce golf balls having the same or similar properties. In other words, one or more of these factors may be changed to compensate for changes in one or more other factors. For example, if the distance between the golf ball core and an IR heater is increased, the IR cure time or the power level of the IR heater may be increased. As another example, if the power level of an IR heater is increased, the IR cure time may be decreased or the distance between the golf ball core and the IR heater may be increased. In a further example, if the IR cure time is increased, the distance between the golf ball core and the IR heater may be increased or the power level of the IR heater may be decreased.

In some implementations, the method of the present disclosure may include an initial cure step that is carried out prior to IR curing the golf ball core. Non-limiting examples of curing processes suitable for use in the initial cure step in accordance with the present disclosure include compression molding, peroxide-curing, sulfur-curing, and combinations thereof. For example, the initial cure step may include compression molding the golf ball core. In some implementations, the golf ball core may be compression molded at a temperature of about 200° F. to 500° F. or about 200° F. to about 400° F. or about 300° F. to about 500° F. In other implementations, the golf ball core may be compression molded at a temperature of about 250° F. to about 400° F. or about 250° F. to about 350° F. or about 300° F. to about 400° F. or about 300° F. to about 350° F. In some implementations, the golf ball core may undergo compression molding for about 1 to about 15 minutes or about 3 to about 12 minutes or about 4 to about 9 minutes. In other implementations, the golf ball core may undergo compression molding for about 3 to about 10 or about 4 to about 7 or about 6 to about 9 or about 5 to about 8 minutes. For example, the initial cure step may include compression molding the golf ball core at a temperature of 300° F. to 350° F. for 4 to 9 minutes.

Golf Ball Properties

Hardness

The hardness of the geometric center of the core may be obtained according to the following: the core is first gently pressed into a hemispherical holder having an internal diameter approximately slightly smaller than the diameter of the core, such that the core is held in place in the hemispherical portion of the holder while concurrently leaving the geometric central plane of the center exposed. The core is secured in the holder by friction, such that it will not move during the cutting and grinding steps, but the friction is not so excessive that distortion of the natural shape of the core would result. The core is secured such that the parting line of the center is roughly parallel to the top of the holder. The diameter of the center is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the geometric center of the core is confirmed with a center square and carefully marked, and the hardness is measured at the center mark according to ASTM D-2240.

Additional hardness measurements at any distance from the geometric center of the core can then be made by drawing a line radially outward from the geometric center mark and measuring the hardness at any given distance along the line, typically in 2 mm increments from the center of the core. The hardness at a particular distance from the geometric center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of the core (or any golf ball layer) is measured on the actual outer surface of the layer and is obtained from the average of a number of measurements taken from opposing hemispheres, taking care to avoid making measurements on the parting line of the core or on surface defects, such as holes or protrusions and preferably making the measurements prior to surrounding the layer of interest with an additional layer. Hardness measurements are made pursuant to ASTM D-2240 "Indentation Hardness of Rubber and Plastic by Means of a Durometer." Because of the curved surface, care must be taken to ensure that the golf ball or golf ball sub-assembly is centered under the durometer indenter before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conforms to ASTM D-2240. It is worthwhile to note that, once an additional layer surrounds a layer of interest, the hardness of the layer of interest can be difficult to determine. Therefore, for purposes of the present disclosure, when the hardness of a layer is needed after the inner layer has been surrounded with another layer, the test procedure for measuring a point located 1 mm from an interface is used.

It should also be noted that there is a fundamental difference between "material hardness" and "hardness as measured directly on a golf ball" (or, as used herein, "surface hardness"). For purposes of the present disclosure, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of layers, and the like); ball (or ball sub-assembly) diameter; and the material composition of adjacent layers. It also should be understood that the two measurement techniques are not linearly related and, therefore, one hardness value cannot easily be correlated to the other. Shore hardness (for example, Shore C or Shore D hardness) was measured according to the test method ASTM D-2240.

A golf ball core made in accordance with the present disclosure may have a hardness at the geometric center of the core, referred to herein as $H_C$, that ranges from about 40 to about 90 Shore C. In one embodiment, the core has a hardness at its geometric center of about 45 to about 65 Shore C or about 48 to about 58 Shore C or about 49 to about 52 Shore C. In another embodiment, the core has a hardness at its geometric center of about 55 to about 75 Shore C or about 60 to about 66 Shore C or about 68 to about 74 Shore C. In yet another embodiment, the core has a hardness at its geometric center of about 65 to about 85 Shore C or about 66 to about 74 Shore C or about 77 to about 84 Shore C.

A golf ball made in accordance with the present disclosure may include a surface of the core, which may be the same as the surface of the skin. The hardness at the surface of the core, referred to herein as $H_S$, may range from about 60 to about 95 Shore C. In one embodiment, the hardness at the surface of the core is about 70 to about 95 Shore C or about 72 to about 82 Shore C or about 85 to about 95 Shore C or about 87 to about 93 Shore C. In another embodiment, the hardness at the surface of the core is about 65 to about 95 Shore C or about 73 to about 93 Shore C or about 74 to about 84 Shore C. In yet another embodiment, the hardness at the surface of the core is about 72 to about 95 Shore C or about 77 to about 85 Shore C or about 88 to about 94 Shore C.

The direction of the hardness gradient is defined by the difference in hardness measurements taken at the geometric center and outer surfaces of the core. The geometric center hardness is readily determined according to the test procedures provided above. For example, the hardness of the outer surface of the core is also readily determined according to the procedures given herein for measuring the outer surface hardness of a golf ball layer, if the measurement is made prior to surrounding the core with additional layers.

While the hardness gradient across the core will vary based on several factors including, but not limited to, the dimensions and formulations of the components, a core formed in accordance with the present disclosure may have a "positive" hardness gradient (that is, the geometric center is softer than the outer surface of the core). More particularly, the term, "positive hardness gradient" as used herein means a hardness gradient of positive about 2 Shore C or greater, about 4 Shore C or greater, about 6 Shore C or greater, about 8 Shore C or greater, or about 10 Shore C or greater. In general, the hardness gradient may be determined by subtracting the hardness value of one component being measured (for example, the geometric center of the core, $H_C$) from the hardness value of another component being measured (for example, the outer surface of the core, $H_S$).

In one embodiment, the core has a positive hardness gradient from the geometric center to the surface of the core of about 2 Shore C to 42 Shore C. In this aspect, the positive hardness gradient of the core is about 5 Shore C to about 40 Shore C. The rubber formulation of the core may be tailored to produce a desired hardness gradient in the core. In some embodiments, the positive hardness gradient of the core is about 30 to about 42 Shore C or about 34 Shore C to 41 Shore C or about 37 Shore C to about 40 Shore C. In other embodiments, the positive hardness gradient of the core is about 3 Shore C to about 25 Shore C or about 10 Shore C to about 23 Shore C, or about 11 Shore C to about 17 Shore C. In further embodiments, the positive hardness gradient of the core may be about 2 Shore C to about 40 Shore C or about 7 Shore C to about 12 Shore C or about 8 Shore C to 11 Shore C.

The hardness of the core may not increase linearly from the center of the core to the outer surface of the core. For example, one or more regions within the core may have a "zero" hardness gradient, i.e., the hardness values across the region are substantially the same. The term, "zero hardness gradient" as used herein means a hardness gradient of −2 Shore C to 2 Shore C, preferably between about −1 Shore C and about 1 Shore C and may have a value of zero. In some embodiments, one or more regions of the core may also have a "negative" hardness gradient, i.e., the hardness values across the region may decrease from the inner edge of the region to the outer edge of the region.

For example, the core, or a layer of the core if the core has multiple layers, may be characterized by three regions: an inner region, an intermediate region, and an outer region. Each of the inner region, intermediate region, and outer region may have its own hardness gradient. For a single-layer core, the inner region is the region of the core surrounding the center of the core and is characterized by positive hardness gradient of about 2 Shore C to about 25 Shore C. In some embodiments, the positive hardness gradient of the inner region of the core is about 6 Shore C to about 25 Shore C or about 16 Shore C to about 23 Shore C. In other embodiments, the positive hardness gradient of the inner region of the core is about 1 Shore C to about 13 Shore C or about 6 Shore C to about 11 Shore C. In further embodiments, the positive hardness gradient of the inner region of the core is about 5 Shore C to about 9 Shore C or about 6 Shore C to about 8 Shore C.

The intermediate region of the core is the region surrounding the inner region and may be characterized by a negative, zero, or positive hardness gradient from about −10 to 8 Shore C. In some embodiments, the intermediate region may have a negative, zero, or positive hardness gradient from −7 to about 6 Shore C or about −6 to about 1 Shore C. In other embodiments, the intermediate region may have a positive hardness gradient from −7 to about 4 Shore C or about −2 to about 4 Shore C. In further embodiments, the intermediate region may have a negative or zero hardness gradient from −10 to about 0 Shore C or about −4 Shore C to about 0 Shore C.

The outer region of the core is the region of the core surrounding the intermediate region and may be characterized by a zero or positive hardness gradient from about −2 Shore C to about 28 Shore C. In some embodiments, the outer region may have a positive hardness gradient from 2 Shore C to about 27 Shore C or about 16 Shore C to about 27 Shore C or about 17 Shore C to about 22 Shore C. In other embodiments, the outer region may have a zero or positive hardness gradient from −2 Shore C to about 16 Shore C or about 2 Shore C to about 6 Shore C or about 10 Shore C to about 15 Shore C. In further embodiments, the outer region may have a zero or positive hardness gradient from −2 Shore C to about 14 Shore C or about 1 Shore C to about 8 Shore C or about 2 Shore C to about 6 Shore C.

In some embodiments, the core may also include a skin region, or "skin." The skin is a thin region adjacent to the outer surface of the core and surrounding the outer region. Without being bound to any particular theory, the skin forms as a result of the IR cure process disclosed herein. The skin may be characterized by a hardness that is greater than the hardness of other regions of the core. In some embodiments, the skin may have a hardness that is greater than other regions of the core by about 0.5 to about 10 Shore C or about 1 to about 10 Shore C or about 1 to about 8 Shore C. In other embodiments, the skin may have a hardness that is greater than other regions of the core by about 2 to about 10 Shore C or about 2 to about 8 Shore C or about 2 to about 5 Shore C or about 5 to about 10 Shore C or about 3 to about 7 Shore C.

In some embodiments, a point or plurality of points measured along a "positive" gradient may be above or below a line fit through the gradient and its outermost and innermost hardness values. In an alternative embodiment, the hardest point along a particular steep "positive" gradient may be higher than the value at the innermost portion of the center (the geometric center) or outer surface of the core—as long as the outermost point (i.e., the outer surface of the core) is greater than the innermost point (i.e., the geometric center of the core), such that the "positive" gradients remain intact.

Compression

Several different methods can be used to measure compression, including Atti compression, Riehle compression, load/deflection measurements at a variety of fixed loads and offsets, and effective modulus (see, e.g., Compression by Any Other Name, Science and Golf IV, Proceedings of the World Scientific Congress of Golf (Eric Thain ed., Routledge, 2002) (J. Dalton). For purposes of the present disclosure, compression values are provided as measured by the Dynamic Compression Machine ("DCM") as well as the Soft Center Deflection Index ("SCDI"). The DCM applies a load to a ball component or a ball and measures the number of inches the core or ball is deflected at measured loads. A crude load/deflection curve is generated that is fit to the Atti compression scale that results in a number being generated that represents an Atti compression. The DCM does this via a load cell attached to the bottom of a hydraulic cylinder that is triggered pneumatically at a fixed rate (typically about 1.0 ft/s) towards a stationary core. Attached to the cylinder is an LVDT that measures the distance the cylinder travels during the testing timeframe. A software-based logarithmic algorithm ensures that measurements are not taken until at least five successive increases in load are detected during the initial phase of the test.

The SCDI is a slight variation of the DCM set up that allows determination of the pounds required to deflect a component or ball 10 percent of its diameter. With the SCDI, the goal is to obtain the pounds of force required to deflect a component or ball a certain number of inches. That amount of deflection is 10 percent of the component or ball diameter. The DCM is triggered, the cylinder deflects the component or ball by 10 percent of its diameter, and the DCM reports back the pounds of force required (as measured from the attached load cell) to deflect the component or ball by that amount. The SCDI value obtained is a single number in units of pounds.

The compression of a core made from the rubber formulation of the present disclosure may range from about 20 to about 120 DCM or more preferably about 50 to about 120 DCM. For example, the core compression may be about 50 to about 85 DCM or about 60 to 80 DCM or about 65 to about 75 DCM. In another example, the core compression may range from about 50 to about 100 DCM or about 55 to about 65 DCM or about 80 to 100 DCM. In yet another example, the core compression is about 60 to about 120 DCM or about 110 to about 120 DCM or about 60 to about 80 DCM or about 71 to about 79 DCM. In some embodiments, it may be desirable for a core comprising the rubber formulation of the present disclosure to have a compression from about 68 to about 75 DCM or from about 70 to about 74 DCM regardless of the hardening agent used.

Diameter

The diameter of the core may vary. In some embodiments, the core diameter may range from about 1.0 to about 1.65 inches or about 1.0 to about 1.5 inches or about 1.1 to about 1.4 inches or about 1.2 to about 1.5 inches or about 1.3 to about 1.65 inches. In other embodiments, the core diameter may range from about 1.0 to about 1.4 inches or about 1.2 to about 1.65 inches. For example, the core may have a diameter of 1.010 to 1.64 inches inches. In embodiments where the core includes two or more layers, the diameter of the inner layer of the core may range from about 1.0 to about 1.4 inches or from about 1.0 to about 1.2 inches.

Core Component Relationships

In one aspect, the amount of water releasing agent and the waters of hydration of the water releasing agent present in the rubber formulation used to form the core are related to the hardness gradient of the core, according to the relationship shown in Equation I below:

$$0.5 \leq \frac{WRA_C * WRA_{WOH}}{1 - \frac{1}{H_{Gr}}} \leq 25 \quad \text{(I)}$$

where $WRA_C$ represents the concentration of water releasing agent in the rubber formulation in parts per hundred; $WRA_{WOH}$ represents the number of waters of hydration in the water releasing agent; and $H_{Gr}$ represents the hardness gradient (Shore C) of the core or the difference between the hardness at the surface of the core and the hardness at the geometric center of the core ($H_S$–$H_C$), and $30 \leq H_{Gr} \leq 50$. For example, if the water releasing agent is calcium sulfate dihydrate, $WRA_{WOH}$ is equal to 2. In another embodiment, $$1 \leq \frac{WRA_C * WRA_{WOH}}{1 - \frac{1}{H_{Gr}}} \leq 22$$

In still another embodiment, $$2 \leq \frac{WRA_C * WRA_{WOH}}{1 - \frac{1}{H_{Gr}}} \leq 16$$

In yet another embodiment, $$2 \leq \frac{WRA_C * WRA_{WOH}}{1 - \frac{1}{H_{Gr}}} \leq 7$$

In another aspect, the number of waters of hydration of the water releasing agent present in the rubber formulation used to form the core is related to the hardness gradient of the core, according to the relationship shown in Equation II below:

$$\frac{WRA_{WOH}}{1 - \frac{1}{H_{Gr}}} \geq 0.5 \quad \text{(II)}$$

where $WRA_{WOH}$ represents the number of waters of hydration in the water releasing agent and $H_{Gr}$ represents the hardness gradient (Shore C) of the core or the difference between the hardness at the surface of the core ($H_S$) and the hardness at the geometric center of the core ($H_C$) ($H_S$–$H_C$), and $30 \leq H_{Gr} \leq 50$. In another embodiment, $$0.5 \leq \frac{WRA_{WOH}}{1 - \frac{1}{H_{Gr}}} < 10$$

In still another embodiment, $$1 \leq \frac{WRA_{WOH}}{1 - \frac{1}{H_{Gr}}} < 7.5$$

In yet another embodiment, $$1.5 \leq \frac{WRA_{WOH}}{1 - \frac{1}{H_{Gr}}} < 4.5$$

In still another, the amount of water releasing agent, the waters of hydration of the water releasing agent, the isomer of hardening agent, and the amount of hardening agent present in the rubber formulation used to form the core are related to the hardness gradient of the core, according to the relationship shown in Equation III below:

$$0.1 \leq \frac{WRA_C * WRA_{WOH} * HA_{LN} * HA_c}{1 - \frac{1}{H_{Gr}}} \leq 70 \quad \text{(III)}$$

where $WRA_C$ represents the concentration of water releasing agent in the rubber formulation in parts per hundred; $WRA_{WOH}$ represents the number of waters of hydration in the water releasing agent; $HA_{LN}$ represents the isomer number of the hardening agent; $HA_C$ represents the concentration of hardening agent in the rubber formulation in parts per hundred; and $H_{Gr}$ represents the hardness gradient (Shore C) of the core or the difference between the hardness at the surface of the core and the hardness at the geometric center of the core ($H_S$–$H_C$), and $30 \leq H_{Gr} \leq 50$. In another embodiment, $$0.2 \leq \frac{WRA_C * WRA_{WOH} * HA_{LN} * HA_C}{1 - \frac{1}{H_{Gr}}} \leq 50$$

In still another embodiment, $$0.4 \leq \frac{WRA_C * WRA_{WOH} * HA_{LN} * HA_C}{1 - \frac{1}{H_{Gr}}} \leq 35$$

In yet another aspect, the amount of EPDM rubber present in the core formulation is related to the hardness gradient of the core, according to the relationship shown in Equation IV below:

$$\frac{EPDM_C}{1 - \frac{1}{H_{Gr}}} \leq 125 \quad \text{(IV)}$$

where $EPDM_C$ represents the concentration of EPDM rubber in the rubber formulation and $H_{Gr}$ represents the hardness gradient (Shore C) of the core or the difference between the hardness at the surface of the core and the hardness at the geometric center of the core ($H_S$–$H_C$), and $30 \leq H_{Gr} \leq 50$. In another embodiment, $$1 \leq \frac{EPDM_C}{1 - \frac{1}{H_{Gr}}} < 35$$

In still another embodiment, $$3 \leq \frac{EPDM_C}{1 - \frac{1}{H_{Gr}}} < 17$$

In yet another embodiment, $$5 \leq \frac{EPMD_C}{1 - \frac{1}{H_{Gr}}} < 11.$$

In a further aspect, the amount of water releasing agent present in the rubber formulation used to form the core is related to the hardness gradient of the core, according to the relationship shown in Equation V below:

$$\frac{WRA_C}{1 - \frac{1}{H_{Gr}}} \leq 20 \quad \text{(V)}$$

where $WRA_C$ represents the concentration of water releasing agent in the rubber formulation in parts per hundred and $H_{Gr}$ represents the hardness gradient (Shore C) of the core or the difference between the hardness at the surface of the core and the hardness at the geometric center of the core ($H_S$–$H_C$), and $30 \leq H_{Gr} \leq 50$. In another embodiment, $$1 \leq \frac{WRA_C}{1 - \frac{1}{H_{Gr}}} < 16$$

In still another embodiment, $$1 \leq \frac{WRA_C}{1 - \frac{1}{H_{Gr}}} < 9$$

In yet another embodiment, $$0.5 \leq \frac{WRA_C}{1 - \frac{1}{H_{Gr}}} < 4$$

Golf Ball Construction

Golf balls having various constructions may be made in accordance with the present disclosure. For example, golf balls having one-piece, two-piece, three-piece, four-piece, and five or more-piece constructions with the term "piece" referring to any core, cover, or intermediate layer of a golf ball construction. Representative illustrations of such golf ball constructions are provided and discussed further below. The term, "layer" as used herein means generally any spherical portion of the golf ball.

Figure 2:
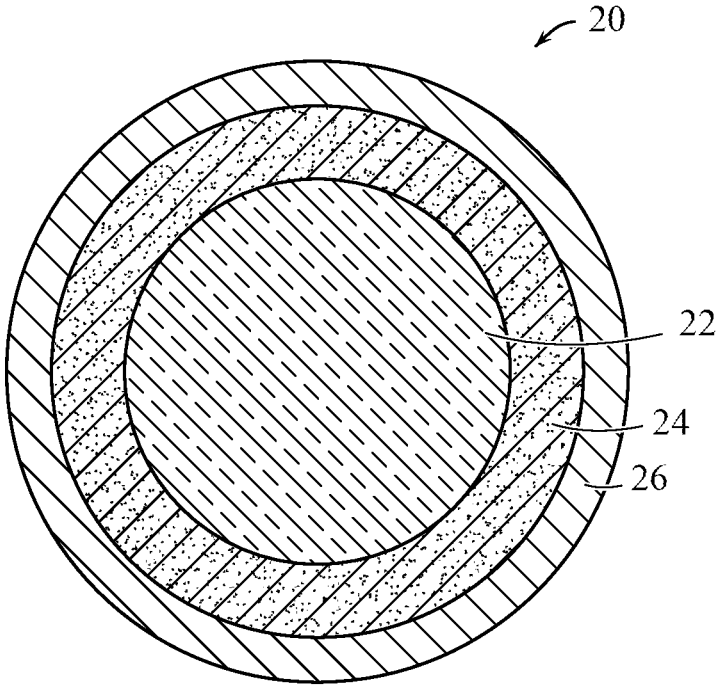
FIG. 2 is a cross-sectional view of a three-piece golf ball in accordance with an embodiment of the present disclosure.
Figure 3:
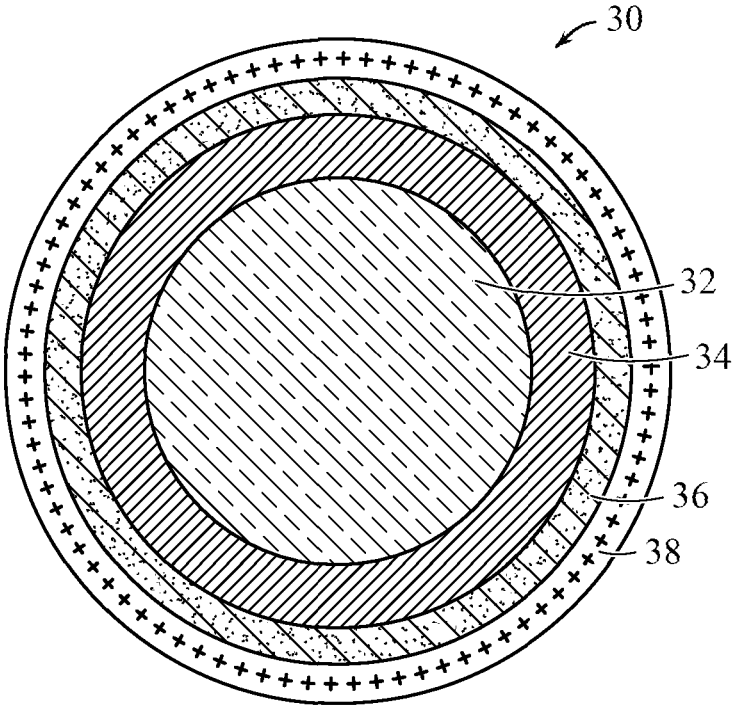
FIG. 3 is a cross-sectional view of a four-piece golf ball in accordance with an embodiment of the present disclosure.
Figure 4:
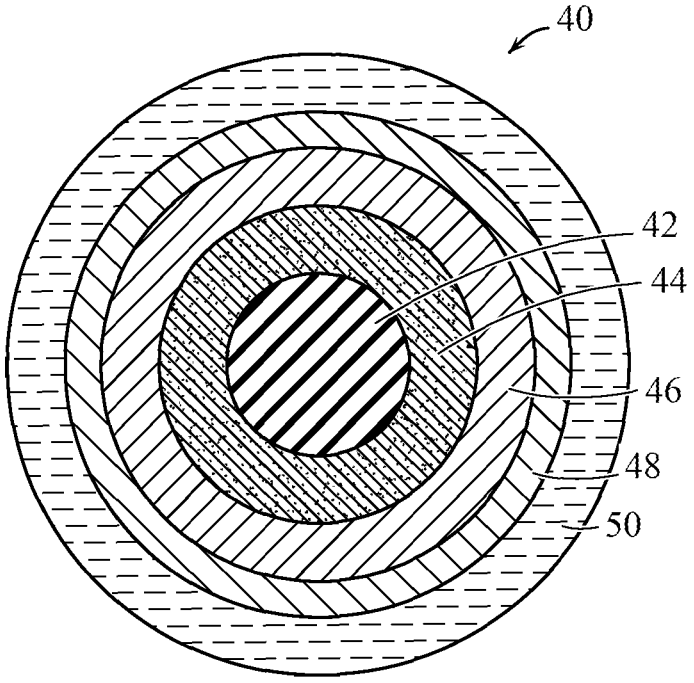
FIG. 4 is a cross-sectional view of a five-piece golf ball in accordance with an embodiment of the present disclosure.

In one embodiment, a golf ball of the present disclosure is a one-piece ball where the core and cover form a single integral layer. In another embodiment, shown in FIG. 1, a golf ball of the present disclosure is a two-piece ball 10 comprising a core 12 and a single cover layer 14. As shown in FIG. 2, in one embodiment, the golf ball 20 includes a core 22, an intermediate layer 24, and a cover layer 26. In FIG. 2, the intermediate layer 24 can be considered an outer core layer, an inner cover layer, a mantle or casing layer, or any other layer disposed between the core 22 and the cover layer 26. Referring to FIG. 3, in another embodiment, a four-piece golf ball 30 includes an inner core layer 32, an outer core layer 34, an intermediate layer 36, and an outer cover layer 38. In FIG. 3, the intermediate layer 36 may be considered a casing or mantle layer, or inner cover layer, or any other layer disposed between the outer core layer 34 and the outer cover of the ball 38. Referring to FIG. 4, in another version, a five-piece golf ball 40 includes a three-layered core having a center 42, an intermediate core layer 44, an outer core layer 46, an inner cover layer 48, and an outer cover layer 50. As exemplified herein, a golf ball in accordance with the present disclosure can include any combination of any number of core layers, intermediate layers, and cover layers.

As discussed above, the golf ball cores made in accordance with the present disclosure may include a skin. Generally, the skin is the region adjacent to the outermost surface of the core. However, in embodiments having a multi-layer core, each core layer may include a skin if each core layer undergoes the IR cure process discussed herein. The skin may be made to a desired depth by controlling the heating of the golf ball core during the IR cure process. For example, the depth of the skin may be increased by increasing the IR cure time, increasing the power level of the IR heater, or decreasing the distance between the golf ball core and the IR heater. In contrast, the depth of the skin may be decreased by decreasing the IR cure time, decreasing the power level of the IR heater, or increasing the distance between the golf ball core and the IR heater. Decreasing the wavelength of the IR radiation may also increase the depth of the skin while increasing the wavelength of the IR radiation may decrease the depth of the skin. Without being bound to any particular theory, IR radiation of a shorter wavelength is better able to penetrate the surface of the core, which results in more heating at a greater depth within the golf ball core.

Figure 5:
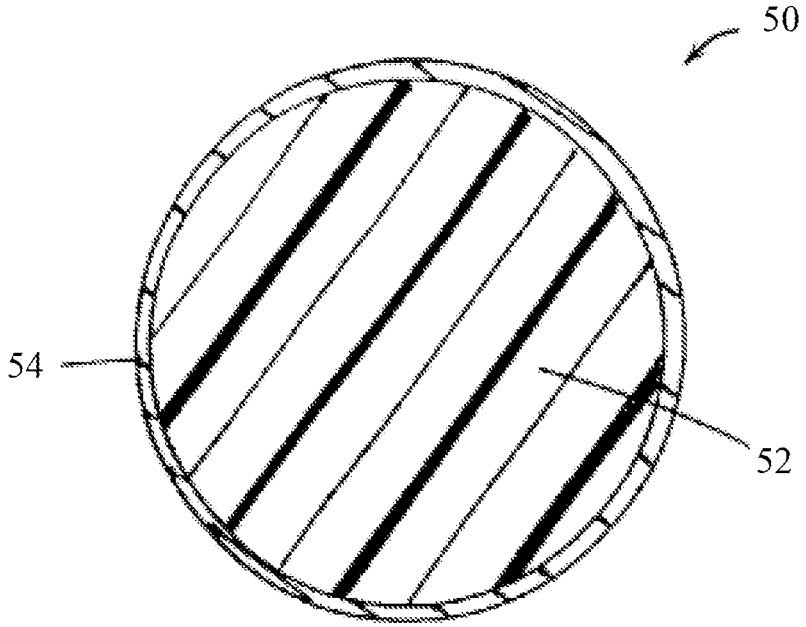
FIG. 5 is a cross-sectional view of a single-layer golf ball core in accordance with an embodiment of the present disclosure.
Figure 6:
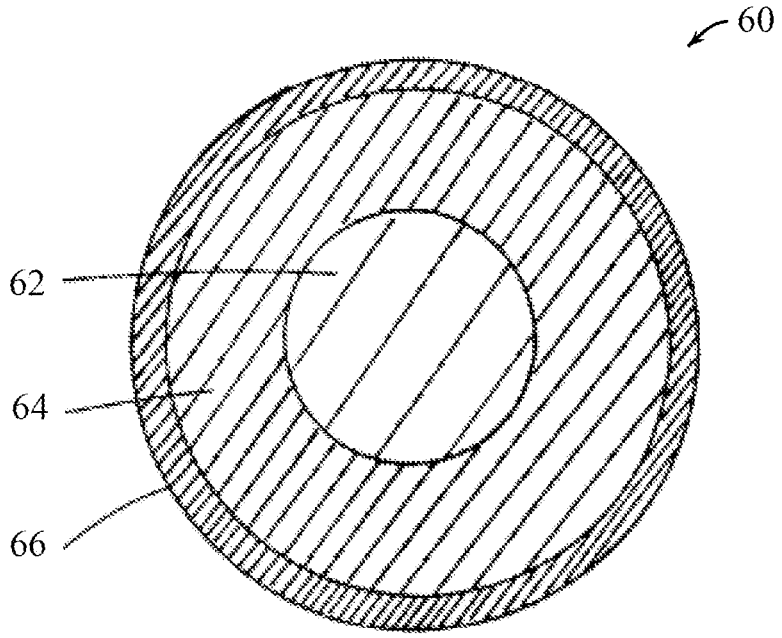
FIG. 6 is a cross-sectional view of another single-layer golf ball core in accordance with an embodiment of the present disclosure.
Figure 7:
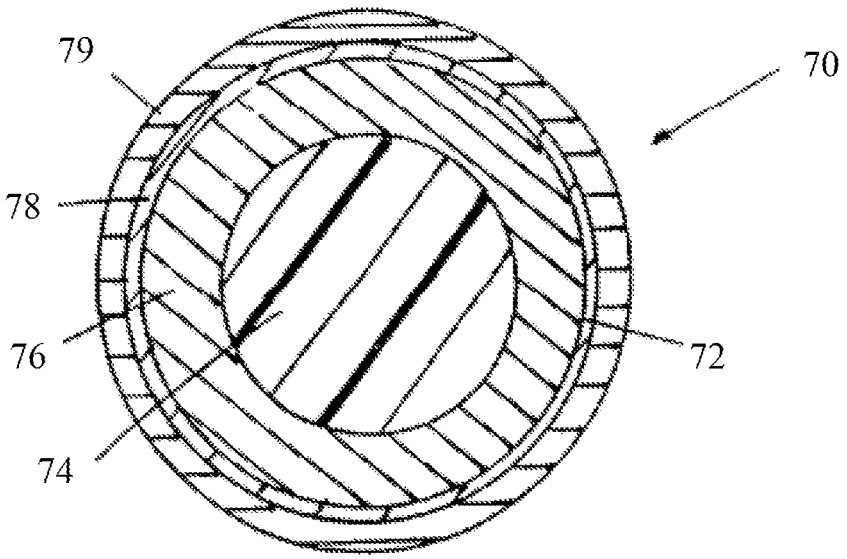
FIG. 7 is a cross-sectional view of another three-piece golf ball in accordance with an embodiment of the present disclosure.

In one embodiment, shown in FIG. 5, a golf ball core of the present disclosure is a spherical core 50 comprising an inner region 52 and a skin 54. The inner region 52 and the skin 54 of the core 50 may be integrally formed. Referring to FIG. 6, in still another embodiment, a golf ball core 60 in accordance with the present disclosure is a spherical core comprising an inner region 62, an outer region 64, and a skin 66. The inner region 62, outer region 64, and skin 66 may integrally form the single-layer golf ball core 60. As shown in FIG. 7, in another embodiment, a golf ball 70 in accordance with the present disclosure includes a multi-layer core 72 having a center 74, an outer core layer 76, a skin 78, and a cover layer 79. The skin 78 may be integrally formed with the outer core layer 76.

The depth of the skin may vary from about 0.001 to about 0.050 inches. In some embodiments, the skin may have a depth of about 0.005 to about 0.045 inches or about 0.005 to about 0.040 inches or about 0.010 to about 0.040 inches. In other embodiments, the skin may have a depth of about 0.010 to about 0.030 inches or about 0.010 to about 0.025 inches or about 0.010 to about 0.020 inches or about 0.015 to about 0.030 inches or about 0.020 to about 0.030 inches or about 0.015 to about 0.025 inches. In further embodiments, the skin may have a depth of about 0.020 to about 0.040 inches or about 0.020 to about 0.035 inches or about 0.025 to about 0.040 inches or about 0.030 to about 0.040 inches or about 0.025 to about 0.035 inches.

The rubber formulations discussed above are suitable for use in the core or one or more of the core layers if multiple core layers are present. It is also contemplated that the core formulations disclosed herein may be used to form one or more of the layers of any of the one, two, three, four, or five, or more-piece (layered) balls described above. That is, any of the core layers, intermediate layers, and/or cover layers may include the rubber formulation of this disclosure. The rubber formulations of different layers may be the same or different. The diameter and thickness of the different layers along with properties such as hardness and compression may vary depending upon the construction and desired playing performance properties of the golf ball.

Golf balls made in accordance with the present disclosure can be of any size, although the USGA requires that golf balls used in competition have a diameter of at least 1.68 inches. For play outside of United States Golf Association (USGA) rules, the golf balls can be of a smaller size. In one embodiment, golf balls made in accordance with the present disclosure have a diameter in the range of about 1.68 to about 1.80 inches.

In contrast to the core, the cover of a golf ball plays less of a role on shots off of a driver. However, because the cover plays a large role in generating spin on iron and wedge shots, the cover material and properties are still important. In this aspect, different materials may be used in the construction of the intermediate and cover layers of golf balls according to the present disclosure. For example, a variety of materials may be used for forming the outer cover including, for example, polyurethanes; polyureas; copolymers, blends and hybrids of polyurethane and polyurea; olefin-based copolymer ionomer resins; polyethylene, including, for example, low density polyethylene, linear low density polyethylene, and high density polyethylene; polypropylene; rubber-toughened olefin polymers; acid copolymers, for example, poly(meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer; cross-linked trans-polyisoprene and blends thereof; polyester-based thermoplastic elastomers; polyurethane-based thermoplastic elastomers; synthetic or natural vulcanized rubber; and combinations thereof.

In one embodiment, the cover is formed from a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Conventional and non-conventional materials may be used for forming intermediate layers of the ball including, for instance, ionomer resins, highly neutralized polymers, polybutadiene, butyl rubber, and other rubber-based core formulations, and the like. In one embodiment, the inner cover layer, i.e., the layer disposed between the core and the outer cover, includes an ionomer. In this aspect, ionomers suitable for use in accordance with the present disclosure may include partially neutralized ionomers and highly neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

Preferred ionomers are salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid mono-ester, ethylene/maleic acid, ethylene/maleic acid mono-ester, ethylene/(meth)acrylic acid/n-butyl (meth)acrylate, ethylene/(meth)acrylic acid/iso-butyl (meth)acrylate, ethylene/(meth)acrylic acid/methyl (meth)acrylate, ethylene/(meth) acrylic acid/ethyl (meth)acrylate terpolymers, and the like. The term, "copolymer," as used herein, includes polymers having two types of monomers, those having three types of monomers, and those having more than three types of monomers. Preferred α, B-ethylenically unsaturated mono- or dicarboxylic acids are (meth) acrylic acid, ethacrylic acid, maleic acid, crotonic acid, fumaric acid, itaconic acid. (Meth) acrylic acid is most preferred. As used herein, "(meth) acrylic acid" means methacrylic acid and/or acrylic acid. Likewise, "(meth) acrylate" means methacrylate and/or acrylate.

In a particularly preferred version, highly neutralized E/X- and E/X/Y-type acid copolymers, wherein E is ethylene, X is a $C_3$-$C_8$ α,β-ethylenically unsaturated carboxylic acid, and Y is a softening monomer are used. X is preferably selected from methacrylic acid, acrylic acid, ethacrylic acid, crotonic acid, and itaconic acid. Methacrylic acid and acrylic acid are particularly preferred. Y is preferably an acrylate selected from alkyl acrylates and aryl acrylates and preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene in the acid copolymer may be at least about 15 weight percent, at least about 25 weight percent, at least about 40 weight percent, or at least about 60 weight percent, based on total weight of the copolymer. The amount of $C_3$ to $C_8$ α,β-ethylenically unsaturated mono- or dicarboxylic acid in the acid copolymer is typically from 1 weight percent to 35 weight percent, from 5 weight percent to 30 weight percent, from 5 weight percent to 25 weight percent, or from 10 weight percent to 20 weight percent, based on total weight of the copolymer. The amount of optional softening comonomer in the acid copolymer may be from 0 weight percent to 50 weight percent, from 5 weight percent to 40 weight percent, from 10 weight percent to 35 weight percent, or from 20 weight percent to 30 weight percent, based on total weight of the copolymer.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals. The amount of cation used in the composition is readily determined based on desired level of neutralization. As discussed above, for HNP compositions, the acid groups are neutralized to 70 percent or greater, 70 to 100 percent, or 90 to 100 percent. In one embodiment, an excess amount of neutralizing agent, that is, an amount greater than the stoichiometric amount needed to neutralize the acid groups, may be used. That is, the acid groups may be neutralized to 100 percent or greater, for example 110 percent or 120 percent or greater. In other embodiments, partially neutralized compositions are prepared, wherein 10 percent or greater, normally 30 percent or greater of the acid groups are neutralized. When aluminum is used as the cation source, it is preferably used at low levels with another cation such as zinc, sodium, or lithium, since aluminum has a dramatic effect on melt flow reduction and cannot be used alone at high levels. For example, aluminum is used to neutralize about 10 percent of the acid groups and sodium is added to neutralize an additional 90 percent of the acid groups.

"Low acid" and "high acid" ionomeric polymers, as well as blends of such ionomers, may be used. In general, low acid ionomers are considered to be those containing 16 weight percent or less of acid moieties, whereas high acid ionomers are considered to be those containing greater than 16 weight percent of acid moieties. In one embodiment, the inner cover layer is formed from a composition comprising a high acid ionomer. A suitable high acid ionomer is Surlyn® 8150. (Dow), which is a copolymer of ethylene and methacrylic acid, having an acid content of 19 weight percent, 45 percent neutralized with sodium. In another embodiment, the inner cover layer is formed from a composition comprising a high acid ionomer and a maleic anhydride-grafted non-ionomeric polymer. An example of a suitable maleic anhydride-grafted polymer is Fusabond® 525D (Dow), which is a maleic anhydride-grafted, metallocene-catalyzed ethylene-butene copolymer having about 0.9 weight percent maleic anhydride grafted onto the copolymer. Blends of high acid ionomers with maleic anhydride-grafted polymers are further disclosed, for example, in U.S. Pat. Nos. 6,992,135 and 6,677,401, the entire disclosures of which are hereby incorporated herein by reference.

The inner cover layer also may be formed from a composition comprising a 50/45/5 blend of Surlyn® 8940/Surlyn® 9650/Nucrel® 960. In this aspect, the composition may have a material hardness of from 80 to 85 Shore C. In another embodiment, the inner cover layer is formed from a composition comprising a 50/25/25 blend of Surlyn® 8940/Surlyn® 9650/Surlyn® 9910, having a material hardness of about 85 to 95 Shore C. In yet another embodiment, the inner cover layer is formed from a composition comprising a 50/50 blend of Surlyn® 8940/Surlyn® 9650, having a material hardness of about 82 to 90 Shore C. A composition comprising a 50/50 blend of Surlyn® 8940 and Surlyn® 7940 also may be used.

The compositions used to make the layers outside of the core, e.g., the outer cover layer and, when present, the inner cover layer, may contain a variety of fillers and additives to impart specific properties to the ball. For example, relatively heavy-weight and light-weight metal fillers such as, particulate; powders; flakes; and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof may be used to adjust the specific gravity of the ball. Other additives and fillers include, but are not limited to, optical brighteners, coloring agents, fluorescent agents, whitening agents, UV absorbers, light stabilizers, surfactants, processing aids, antioxidants, stabilizers, softening agents, fragrance components, plasticizers, impact modifiers, titanium dioxide, clay, mica, talc, glass flakes, milled glass, and mixtures thereof.

The outer cover layer preferably has a material hardness of 85 Shore C or less. The thickness of the outer cover layer is preferably within a range having a lower limit of 0.010 or 0.015 or 0.025 inches and an upper limit of 0.035 or 0.040 or 0.055 or 0.080 inches. Methods for measuring hardness of the layers in the golf ball are described in further detail above. When included, the inner cover layer preferably has a material hardness within a range having a lower limit of 70 or 75 or 80 or 82 Shore C and an upper limit of 85 or 86 or 90 or 92 Shore C. The thickness of the intermediate layer is preferably within a range having a lower limit of 0.010 or 0.015 or 0.020 or 0.030 inches and an upper limit of 0.035 or 0.045 or 0.080 or 0.120 inches.

In one embodiment, the golf balls made in accordance with the present disclosure include a core comprising a rubber formulation as described herein, an inner cover layer formed from an ionomeric material, and the outer cover layer is formed from a polyurethane material, and the outer cover layer has a hardness that is less than that of the inner cover layer. For example, the inner cover layer may have a hardness of greater than about 60 Shore D and the outer cover layer may have a hardness of less than about 60 Shore D. In an alternative embodiment, the inner cover layer is composed of a partially or fully neutralized ionomer, a thermoplastic polyester elastomer, a thermoplastic polyether block amide, or a thermoplastic or thermosetting polyurethane or polyurea, and the outer cover layer is composed of an ionomeric material. In this alternative embodiment, the inner cover layer may have a hardness of less than about 60 Shore D and the outer cover layer may have a hardness of greater than about 55 Shore D and the inner cover layer hardness is less than the outer cover layer hardness.

When a dual cover is disposed about the core, the inner cover layer may have a thickness of about 0.01 inches to about 0.06 inches, about 0.015 inches to about 0.040 inches, or about 0.02 inches to about 0.035 inches. The outer cover layer may have a thickness of about 0.015 inches to about 0.055 inches, about 0.02 inches to about 0.04 inches, or about 0.025 inches to about 0.035 inches.

The golf balls of the present disclosure may be formed using a variety of application techniques. For example, the golf ball, golf ball core, or any layer of the golf ball may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. In this aspect, cover layers may be formed over the core using any suitable technique that is associated with the material used to form the layer. Preferably, each cover layer is separately formed over the core. For example, an ethylene acid copolymer ionomer composition may be injection-molded to produce half-shells over the core. Alternatively, the ionomer composition can be placed into a compression mold and molded under sufficient pressure, temperature, and time to produce the hemispherical shells, which may then be placed around the core in a compression mold. An outer cover layer including a polyurethane or polyurea composition over a ball sub-assembly may be formed by using a casting process.

Golf balls made in accordance with the present disclosure may be subjected to finishing steps such as flash-trimming, surface-treatment, marking, coating, and the like using techniques known in the art. In one embodiment, a white-pigmented cover may be surface-treated using a suitable method such as, for example, corona, plasma, or ultraviolet (UV) light-treatment. Indicia such as trademarks, symbols, logos, letters, and the like may be printed on the cover using pad-printing, ink-jet printing, dye-sublimation, or other suitable printing methods. Clear surface coatings (for example, primer and topcoats), which may contain a fluorescent whitening agent, may be applied to the cover. Golf balls may also be painted with one or more paint coatings in a variety of colors. In one embodiment, white primer paint is applied first to the surface of the ball and then a white top-coat of paint may be applied over the primer.

EXAMPLES

The invention is further illustrated by the following examples. It should be understood that the examples below are for illustrative purposes only. These examples should not be construed as limiting the scope of the invention.

The golf ball cores and golf balls of these examples are made using core formulations in accordance with the present disclosure. Examples of rubber formulations for use in forming cores in accordance with the present disclosure are included below. These examples provide the components included in each rubber formulation. Concentrations of each component are provided in parts by weight per 100 parts of the total rubber unless stated otherwise.

Example 1

The following examples describe compositions of golf ball cores having a single layer (solid sphere) or the inner core of a dual-layer core made from rubber formulations in accordance with the present disclosure. The rubber formulations below include a base rubber including polybutadiene rubber and in some embodiments, EPDM; a co-agent, zinc diacrylate; a first filler, zinc oxide; a second filler, barium sulfate; a radical scavenger, Zn-PCTP-72; an initiator, dicumyl peroxide; a water releasing agent, calcium sulfate dihydrate; and a hardening agent, nitrophenol. Concentrations of the components are in parts per hundred rubber. For the IR cure process, each golf ball core was exposed to IR radiation in the range of 5-7 microns at a distance of 2.5 to 3 inches from the IR heater with the IR heater having a surface temperature of 400° F. to 420° F. The compositions and properties of the cores are described in Table 1 below.

TABLE 1

Golf Ball Cores Including Calcium Sulfate Dihydrate

| | | A | B |
|---|---|---|---|
| Composition | Polybutadiene Rubber | 100 | 95 |
| | EPDM | 0 | 5 |
| | Zinc Oxide | 5 | 5 |
| | Barium Sulfate | 12.4 | 11 |
| | ZnPCTP | 0.34 | 0.34 |
| | Zinc Diacrylate | 30.5 | 34 |
| | Dicumyl Peroxide | 1.0 | 0.6 |
| | Calcium Sulfate Dihydrate | 3.0 | 3.0 |
| IR Cure | IR Cure Time (min) | 4 | 8 |
| Skin | Skin Depth (inches) | 0.01 | 0.04 |
| Properties | Difference in Hardness of Skin and Underlying Core Region (Shore C) | 2 | 5 |

As shown in Table 1, exposing the golf ball core to IR radiation for a longer time generally increases the depth of the skin and the difference in the hardness of the skin and the underlying core region. In Table 1, the only IR cure parameter that was changes was the IR cure time. However, similar results may be found by reducing the distance between the golf ball core and the IR heater or increasing the power level of the IR heater. Without being bound to any particular theory though, reducing the distance between the golf ball core and the IR heater or increasing the power level of the IR heater may increase difference in the hardness of the skin and the underlying core region without significantly increasing the skin depth. Generally, shortening the wavelength of the IR radiation may result in a deeper skin depth but may not increase the difference between the hardness of the skin and the adjacent core layer. Notwithstanding the above, a person having ordinary skill in the art would understand that the optimal IR cure time, IR radiation wavelength, distance between the golf ball core and the IR heater, IR heater power level, and relative amount of each component used would depend on the desired properties of the resulting golf ball core and the desired performance characteristics of the golf ball made therefrom.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball, comprising:

a core having a center and a skin disposed about the center, wherein the core is formed from a rubber formulation cured under infrared radiation, the rubber formulation comprising:

a base rubber, and a water releasing agent comprising a metal salt hydrate, wherein the water releasing agent has 1 to 4 waters of hydration and is present in an amount of about 0.7 to about 1.4 parts by weight per 100 parts of the base rubber; and a cover layer disposed about the core, wherein the center has a hardness ranging from about 45 Shore C to about 65 Shore C, wherein the skin has a hardness ranging from about 60 Shore C to about 95 Shore C, wherein the core possesses a hardness gradient substantially equal to the difference in the center hardness and the skin hardness, and wherein the hardness gradient is at least 30 Shore C.

2. The golf ball of claim 1, wherein the skin has a depth that is between about 0.005 and 0.04 inches.

3. The golf ball of claim 1, wherein the skin has a depth that is less than 0.01 inch.

4. The golf ball of claim 1, wherein the skin hardness is at least 5 Shore C harder than any point in the center.

5. The golf ball of claim 1, wherein the center has a hardness ranging from about 48 Shore C to about 58 Shore C, wherein the skin has a hardness ranging from about 85 Shore C to about 95 Shore C.

6. The golf ball of claim 1, wherein the rubber formulation further comprises a compression agent.

7. The golf ball of claim 1, wherein the base rubber comprises polybutadiene rubber, butyl rubber, EPDM rubber, or a blend thereof.

8. The golf ball of claim 1, wherein the cover layer comprises a material selected from the group consisting of polyurethanes, polyureas, and hybrids, copolymers, and blends thereof.

9. The golf ball of claim 1, wherein the water releasing agent has two waters of hydration.

10. A golf ball, comprising:

a multi-layer core comprising a center and an outer core layer disposed about the center, the outer core layer having a skin forming an exterior of the outer core layer, wherein the outer core layer is formed from a rubber formulation cured under infrared radiation, the rubber formulation comprising:

a base rubber, and a water releasing agent comprising a metal salt hydrate, wherein the water releasing agent has 1 to 4 waters of hydration and is present in an amount of about 0.7 to about 1.4 parts by weight per 100 parts of the base rubber; and a cover layer disposed about the core, wherein the center has a hardness ranging from about 45 Shore C to about 65 Shore C, wherein the skin has a hardness ranging from about 70 Shore C to about 95 Shore C, wherein the core possesses a hardness gradient substantially equal to the difference in the center hardness and the skin hardness, and wherein the hardness gradient is at least 30 Shore C.

11. The golf ball of claim 10, wherein the skin has a depth that is between about 0.005 and 0.04 inches.

12. The golf ball of claim 10, wherein the skin has a depth that is less than 0.01 inch.

13. The golf ball of claim 10, wherein the center hardness ranges from about 49 Shore C to about 52 Shore C and the skin hardness ranges from about 72 Shore C to about 82 Shore C.

14. A golf ball, comprising:

a core comprising:

a center having a geometric center hardness $H_C$ ranging from about 45 Shore C to about 65 Shore C;

a skin disposed about the center and including a surface having a surface hardness $H_S$ ranging from about 60 Shore C to about 95 Shore C; and a hardness gradient $H_{Gr}$ equal to the difference between $H_C$ and $H_S$, wherein the core is formed from a rubber formulation comprising a base rubber and a metal salt hydrate having a water releasing agent concentration $WRA_C$ ranging from about 0.7 parts to about 1.4 parts by weight per 100 parts of the base rubber, and waters of hydration, $WRA_{WOH}$ ranging between 1 and 4, wherein $H_{Gr}$ is equal to or greater than 30 Shore C, wherein $H_S$ is at least 2 Shore C harder than any point in the center, and wherein $$1 \le \frac{WRA_C * WRA_{WOH}}{1 - \frac{1}{H_{Gr}}} \le 22;$$

and a cover layer disposed about the core.

15. The golf ball of claim 14, wherein $$2 \le \frac{WRA_C * WRA_{WOH}}{1 - \frac{1}{H_{Gr}}} \le 16.$$

16. The golf ball of claim 14, wherein $$2 \le \frac{WRA_C * WRA_{WOH}}{1 - \frac{1}{H_{Gr}}} \le 7.$$

17. The golf ball of claim 14, wherein $$0.5 \le \frac{WRA_{WOH}}{1 - \frac{1}{H_{Gr}}} < 10.$$

18. The golf ball of claim 14, wherein $$1 \le \frac{WRA_{WOH}}{1 - \frac{1}{H_{Gr}}} < 7.5.$$

19. The golf ball of claim 14, wherein the skin has a depth that is between about 0.005 and 0.04 inches.

* * * * *